US007741005B2

(12) United States Patent
Yanaka et al.

(10) Patent No.: US 7,741,005 B2
(45) Date of Patent: Jun. 22, 2010

(54) PLANOGRAPHIC PRINTING PLATE PRECURSOR AND STACK THEREOF

(75) Inventors: Hiromitsu Yanaka, Shizuoka-ken (JP); Shigeo Koizumi, Shizuoka-ken (JP); Hisao Yamamoto, Shizuoka-ken (JP)

(73) Assignee: FUJIFILM Corporation, Tokyo (JP)

( * ) Notice: Subject to any disclaimer, the term of this patent is extended or adjusted under 35 U.S.C. 154(b) by 81 days.

(21) Appl. No.: 11/730,411

(22) Filed: Apr. 2, 2007

(65) Prior Publication Data

US 2007/0231740 A1 Oct. 4, 2007

(30) Foreign Application Priority Data

Mar. 31, 2006 (JP) ..... 2006-100900

(51) Int. Cl.
*G03C 1/00* (2006.01)
*G03C 1/36* (2006.01)

(52) U.S. Cl. ..... 430/270.1; 430/273.1; 430/272.1; 101/453

(58) Field of Classification Search ..... 430/270.1, 430/302, 611; 101/453
See application file for complete search history.

(56) References Cited

U.S. PATENT DOCUMENTS 5,322,268 A * 6/1994 Okutsu et al. ..... 271/11
5,948,600 A * 9/1999 Roschger et al. ..... 430/348
7,086,333 B2 * 8/2006 Sampei et al. ..... 101/453
2002/0127489 A1 * 9/2002 Denzinger et al. ..... 430/270.1
2004/0029056 A1 * 2/2004 Tsukada ..... 430/611
2005/0005794 A1 * 1/2005 Inukai et al. ..... 101/453
2005/0202341 A1 * 9/2005 Tsuchimura ..... 430/270.1
2006/0069177 A1 * 3/2006 Sachdev et al. ..... 522/73
2007/0148593 A1 * 6/2007 Shimada et al. ..... 430/270.1

FOREIGN PATENT DOCUMENTS

JP 11-38633 A 2/1999
JP 2004-318053 A 11/2004

* cited by examiner

*Primary Examiner*—Cynthia H Kelly
*Assistant Examiner*—Chanceity N Robinson
(74) *Attorney, Agent, or Firm*—Sughrue Mion, PLLC

(57) ABSTRACT

The present invention provides a planographic printing plate precursor, including: a support; and a photosensitive layer containing a polymerizable compound; an oxygen barrier layer; and a protective layer containing a filler (preferably an organic resin particle), the layers being formed in this order on the support. The present invention also provides a stack of planographic printing plate precursors, produced by stacking the planographic printing plate precursors with the photosensitive layer side outermost layer and the support side rear surface of the adjacent plate precursor in direct contact with each other.

11 Claims, No Drawings

PLANOGRAPHIC PRINTING PLATE PRECURSOR AND STACK THEREOF

CROSS-REFERENCE TO RELATED APPLICATION

This application claims priority under 35 USC 119 from Japanese Patent Applications No. 2006-100900, the disclosure of which is incorporated by reference herein.

BACKGROUND OF THE INVENTION

1. Field of the Invention

The present invention relates to a negative planographic printing plate precursor. More specifically, it relates to a planographic printing plate precursor capable of image formation by irradiation such as visible or infrared laser, and thermal image formation with ultraviolet lamps, thermal heads, and the like. The present invention also relates to a stack of the planographic printing plate precursors.

2. Description of the Related Art

Conventionally, a plate having a lipophilic photosensitive resin layer provided on a hydrophilic support has been used widely as a planographic printing plate precursor, and a desired printing plate is obtained by a plate-making method which usually involves masked light exposure (surface light exposure) via a lithographic film and then removing a non-image area by dissolution. In recent years, digitalization techniques which involve electronic processing, accumulation and output of image information with a computer are spreading. A wide variety of new image output systems compatible with these digitalization techniques have come to be used in practice. As a result, there has been demand for computer-to-plate (CTP) techniques for producing a printing plate directly by scanning a highly directional light such as a laser light according to digitalized image information without a lithographic film, and the provision of a planographic printing plate precursor adapted to these techniques has proved a significant technical challenge.

Examples of the proposed negative planographic printing plate precursors allowing such a scanning exposure include those having a photopolymerizable photosensitive layer containing a photopolymerization initiator, an addition polymerizable ethylenic unsaturated compound, and a binder polymer having a repeating unit of a particular structure soluble in alkaline developing solution, and as needed an oxygen blocking protective layer, formed on a hydrophilic substrate, (see, for example, Japanese patent application laid-open (JP-A) No. 2004-318053). Also proposed were negative planographic printing plate precursors having a photopolymerizable photosensitive layer and an oxygen blocking protective layer containing an added inorganic lamellar compound formed on a hydrophilic substrate, (see, for example, JP-A No. 11-38633).

There exists a need for further improvement in productivity in platemaking of such photopolymerizable negative planographic printing plate precursors. For example, shortening a time required for the exposure step leads to improvements in productivity. Normally, photopolymerizable planographic printing plate precursors are stored, transported, and converted into printing plates in a state in which they are stacked with interleaf sheets inserted between plate precursors. In platemaking with such stacks of planographic printing plate precursors, the interleaf sheets need to be removed in the exposure step, and the period of time needed for removing the interleaf sheets makes the exposure step more inefficient. To improve such inefficiency, it is possible to eliminate the step of removing the interleaf sheets by stacking the planographic printing plate precursors without inserting interleaf sheets.

The interleaf sheet has a function of preventing adhesion between planographic printing plate precursors, and preventing scratching due to abrasion between the photosensitive layer side surface of a planographic printing plate precursor and the support side back surface of the adjacent plate precursor. Thus, in conventional photopolymerizable planographic printing plate precursors, when stacked without inserting interleaf sheets therebetween, problems occurred that the planographic printing plate precursors adhered to each other, and the photosensitive layer side surface of the support was abraded and scratched with the rear surface of the adjacent planographic printing plate precursor, and so further improvement is demanded.

As described above, there has been a need for a planographic printing plate precursor, which even when plural planographic printing plate precursors are stacked with no interleaf sheets, is excellent in preventing adhesion between planographic printing plate precursors, and capable of suppressing occurrence of scratches caused by abrasion between a photosensitive layer side surface and a back surface of a support. However, such a planographic printing plate precursor has not yet been provided.

SUMMARY OF THE INVENTION

The present invention has been made in view of the circumstances described above.

A first aspect of the invention is to provide a planographic printing plate precursor including a support, and a photosensitive layer containing a polymerizable compound, an oxygen barrier layer, and a protective layer including a filler formed in this order on or above the support.

A second aspect of the invention is to provide a stack of planographic printing plate precursors comprising a plurality of the planographic printing plate precursors in the first aspect of the invention, wherein an outermost surface of a photosensitive layer side of a planographic printing plate precursor directly contacts a back surface of a support of a adjacent planographic printing plate precursor.

DETAILED DESCRIPTION OF THE INVENTION

The planographic printing plate precursor according to the present invention includes a support, and a photosensitive layer containing a polymerizable compound, an oxygen barrier layer, and a protective layer including a filler formed in this order on or above the support.

The phrase "form(ed) in this order" means that a photosensitive layer, an oxygen barrier layer, and a protective layer are arranged on or above a support in this order, but this phrase dose not deny the presence of other layers (for example, an intermediate layer, a back coat layer, etc.) arranged in accordance with specific objectives.

In the present specification ". . . to . . . " represents a range including the numeral values represented before and after "to" as a minimum value and a maximum value, respectively.

While the function of the present invention has not been elucidated yet, it is presumed to be as follows.

The filler contained in the protective layer according to the invention is considered to function as a matting agent. Thus, even when the planographic printing plate precursors are stacked directly without inserting interleaf sheets, it is possible to effectively prevent adhesion and occurrence of scratches between the outermost surface of the photosensitive layer and the back surface of the adjacent support caused by stacking the precursors, and is also possible to improve the efficiency of platemaking operation.

Moreover, since the planographic printing plate precursor according to the invention has the oxygen barrier layer between the photosensitive layer and the protective layer, it is possible to block oxygen from outside sufficiently. Thus, oxygen permeation which causes polymerization inhibition is effectively suppressed, therefore it is considered that a deterioration in curing reaction is suppressed and high-quality image formation without any defects of image formation is achieved.

Further, by using a resin filler having low oxygen permeability as the filler contained in the protective layer enables the oxygen blocking property to be improved even more. Thus, the deterioration of the curing reaction is more efficiently suppressed, and a high-quality image formation without any portions where the image is missing in the exposed areas may be achieved.

Hereinafter, each layer in the planographic printing plate precursor according to the invention will be described in detail.

<Protective Layer>

First, the protective layer will be described in detail.

The protective layer according to the present invention, which has a role of protecting the oxygen barrier layer, contains a filler and is formed on or above the oxygen barrier layer. The protective layer preferably contains a binder polymer, and it may further contain other components as needed.

(Filler)

The surface of the protective layer is matted by the addition of the filler in the protective layer of the present invention. That is, due to roughening the surface of the protective layer, the surface area that may adhere to the adjacent support is reduced. Thus, effects of preventing adhesion between the surface the protective layer and the back surface of the adjacent support and suppressing occurrence of scratches on the surface of the protective layer are exhibited, even when multiple planographic printing plate precursors are stacked directly without inserting interleaf sheets.

The filler preferably does not practically inhibit light transmittance, and does not become soft or sticky by moisture in the air or heat (at least at a temperature of 60° C. or below). Further, since the surface of the protective layer can effectively exhibit the effects above by being matted to some extent, the Bekk smoothness thereof, as an indicator of surface irregularity, is preferably 500 seconds or less, more preferably 150 seconds or less.

The Bekk smoothness is determined by measuring the period of time required to allow permeation of air of 1 cc in volume by using a Bekk smoothness meter manufactured by Kumagai Riki Kogyo Co., Ltd., as an analyzer.

The Bekk smoothness of the surface of the protective layer can be controlled in the range above, for example, by adjusting the kind, shape, particle size, or addition amount of the filler.

The filler for use in the protective layer is, from the viewpoint of preventing scratches, preferably an organic particle which is relatively soft, elastic, allowing relaxation of stress generated when the particle is rubbed by the surface of the support. Further, an organic resin particle is preferable from the viewpoint of exhibiting these effects even when multiple planographic printing plate precursors are stacked under pressure. In particular, a resin particle of which constituting resin has a crosslinked structure is particularly preferable in order to prevent fusion with heat. The organic resin particle is preferably a resin particle that has a high affinity with a binder in the protective layer, is sufficiently mixed in the layer, and does not fall out from the surface of the layer.

Examples of the organic resin particles having such properties include synthetic resin particles such as of poly(meth) acrylic esters, polystyrene and derivatives thereof, polyamides, polyimides, polyolefins such as low-density polyethylene, high-density polyethylene and polypropylene, and copolymers thereof with polyvinyl alcohol, polyurethanes, polyureas, and polyesters; and natural polymer particles such as of chitin, chitosan, cellulose, crosslinked starch, and crosslinked cellulose; and the like. Among them, synthetic resin particles have the merit that the particle size is easy to control, and desired surface properties may be easily controlled by surface modification.

Such organic resin particles may be produced by crushing methods if the resin is relatively hard, however, a method of forming particles by emulsification-suspension polymerization is mainly employed recently, from the viewpoints of ease and accuracy of controlling particular size. Methods of producing such particles are described in detail, for example, in "Biryushi-Funtai no Sakusei to Oyo (Preparation and Application of Fine Particles and Powder)", 1st Ed., Haruma Kawaguchi Ed., CMC Publishing Co., Ltd. 2005.

Examples of commercially available organic resin particle having such properties that are favorably used in the protective layer include crosslinked acrylic resins MX-300, MX-500, MX-1000, MX-1500H, MR-2HG, MR-7HG, MR-10HG, MR-3GSN, MR-5GSN, MR-7G, MR-10G, MR-5C, and MR-7GC, and styryl-based resins SX-350H and SX-500H, manufactured by Soken Chemical & Engineering Co., Ltd.; acrylic resins MBX-5, MBX-8, MBX-12, MBX-15, MBX-20, MB20X-5, MB30X-5, MB30X-8, MB30X-20, SBX-6, SBX-8, SBX-12, and SBX-17, manufactured by Sekisui Plastics Co., Ltd.; polyolefin resins Chemipearl W100, W200, W300, W308, W310, W400, W401, W405, W410, W500, WF640, W700, W800, W900, W950, and WP100 manufactured by Mitsui Chemicals, Inc.; thermoplastic elastomer (A-100) manufactured by Mitsui Chemicals, Inc.; acrylic resin (Techpolymer ARX-806) manufactured by Sekisui Chemical Co., Ltd.; and the like.

In addition, other filler such as an inorganic filler may be used alone, or two or more combination of fillers such as the inorganic filler and the organic resin particle may be used.

Examples of the inorganic filler include metals, metal compounds such as oxide, mixed oxide, hydroxide, carbonate salt, sulfate salt, silicate salt, phosphate salt, nitride, carbide and sulfide, composites of at least two or more of them, and the like. Specific examples thereof include glass, zinc oxide, alumina, zirconium oxide, tin oxide, potassium titanate, strontium titanate, aluminum borate, magnesium oxide, magnesium borate, aluminum hydroxide, magnesium hydroxide, calcium hydroxide, titanium hydroxide, basic magnesium sulfate, calcium carbonate, magnesium carbonate, calcium sulfate, magnesium sulfate, calcium silicate, magnesium silicate, calcium phosphate, silicon nitride, titanium nitride, aluminum nitride, silicon carbide, titanium carbide, zinc sulfide, the composites of at least two or more thereof, and the like. Among them, preferable inorganic fillers include glass, alumina, potassium titanate, strontium titanate, aluminum borate, magnesium oxide, calcium carbonate, magnesium carbonate, calcium silicate, magnesium silicate, calcium phosphate, calcium sulfate.

Examples of commercially available products of the preferable inorganic filler include silica fine particles such as Mizukasil P-510, P-526, P-603, P-604, P-527, P-802, P-553A, P-73, P-78A, P-78F, P-705, and P-707 manufactured by Mizusawa Industrial Chemicals, Ltd.

Examples of the shape of the filler include fiber, needle, plate, sphere, granule (undefined, the same shall apply hereinafter), tetrapod, balloon and the like. Among them, preferables are spherical and granular.

The particle size distribution may be monodispersion or polydispersion, but is preferably monodispersion. The size of the filler, specifically the average particle diameter (volume average particle diameter), is preferably 1 to 20 μm, more preferably 2 to 15 μm, and still more preferably 3 to 10 μm. It is possible to maximize the advantageous effects of the invention by adjusting the filler size in the range above.

The volume average particle diameter of the filler is determined by using an analytical instrument (trade name: LA-910W, manufactured by Hitachi-Horiba, Co. Ltd.) as the analyzer.

The content of the filler is preferably 0.1 to 20% by mass, more preferably 1 to 15% by mass, and more preferably 2 to 10% by mass, with respect to the total solid content in the protective layer.

If supplied as a powder, the filler can be dispersed in the aqueous binder solution for the protective layer in a simple dispersing machine such as homogenizer, homomixer, ball mill, or paint shaker. Addition of a surfactant then as needed leads to stabilization of the dispersed particles.

The surfactant for use during dispersion may be any one of nonionic, anionic, and cationic surfactants. Examples of the nonionic surfactants include polyethylene glycol alkylethers, alkenylethers, polyethylene glycol alkylesters, polyethylene glycol arylethers, and the like. Examples of the anionic surfactants include surfactants of alkyl- or aryl-sulfonate salts, alkyl- or aryl-sulfate ester salts, alkyl- or aryl-phosphate ester salts, and alkyl- or aryl-carboxylate salts. Examples of the cationic surfactants include surfactants of alkylamine salts, alkylpyridinium salts, and alkylammonium salts. More specifically, specific examples of the surfactants include those described in "Saishin—Kaimen Kasseizai no Kino Sosei—Sozai Kaihatsu—Oyo Gijyutsu (Up-to-date Function, Raw Material, and Application of Surfactants)", Teruo Terauchi and Toshiyuki Suzuki, Gijutu Kyoiku Shuppansha.

As for fillers in the state dispersed in water, such as Chemipearl series products manufactured by Mitsui Chemicals, Inc., it is possible to prepare a coating solution by adding the dispersion directly to the aqueous protective layer solution.

(Binder)

The protective layer according to the invention preferably contains a binder polymer.

The binder for use in the protective layer according to the invention is preferably a water-soluble polymer compound with good relative crystallinity. Specific examples thereof include water-soluble polymers such as a polyvinylalcohol, a polyvinylpyrrolidone, an acidic celluloses, a gelatin, a gum arabic, and a polyacrylic acid. Among them, use of a polyvinylalcohol as the main component is particularly preferable, from the viewpoint of physical properties of the protective layer. The polyvinylalcohol for use in the protective layer may be partly substituted with ester, ether, and acetal, in the range that the polyvinylalcohol still contains unsubstituted vinylalcohol units to the degree that it still has preferable oxygen blocking property and water-solubility needed for the protective layer. Similarly, it may partly have other repeating units.

Examples of the commercially available products suitably used include PVA-102, PVA-103, PVA-104, PVA-105, PVA-110, PVA-117, PVA-117H, PVA-120, PVA-124, PVA-124H, PVA-135H, PVA-CS, PVA-CST, PVA-HC, PVA-203, PVA-204, PVA-205, PVA-210, PVA-217, PVA-220, PVA-224, PVA-217EE, PVA-217E, PVA-220E, PVA-224E, PVA-405, PVA-420, PVA-613, PVA-617, PVA-624, PVA-706, and L-8, manufactured by Kuraray Co. Ltd.; Gohsenol NL-05, NM-11, NM-14, AL-06, P-610, C-500, A-300, and AH-17, manufactured by Nippon Synthetic Chemical Industry Co., Ltd.; JF-04, JF-05, JF-10, JF-17, JF-17L, JM-05, JM-10, JM-17, JM-17L, JT-05, JT-13, JT-15, manufactured by Nippon Synthetic Chemical Industry Co., Ltd.; and the like.

Examples of the copolymers above include 88 to 100% hydrolyzed polyvinyl acetate chloroacetate or propionate, polyvinylformal, polyvinylacetal and the copolymers thereof. Other useful polymers include polyvinylpyrrolidone, gelatin, gum arabic, and the like, and these polymers may be used alone or in combination of two or more of them.

In the invention, among the polyvinylalcohols above, polyvinylalcohols hydrolyzed in an amount of 71 to 100% and having a molecular weight in the range of 200 to 2,400 are preferably used. Polyvinylalcohols having a saponification degree of 91 mol % or more are used more preferably, form the viewpoints of obtaining a film having high oxygen blocking property and superior film-forming property, and low adhesive surface.

Specific examples thereof include PVA-102, PVA-103, PVA-104, PVA-105, PVA-110, PVA-117, PVA-120, PVA-124, PVA-117H, PVA-135H, PVA-HC, PVA-617, PVA-624, PVA-706, PVA-613, PVA-CS, and PVA-CST, manufactured by Kuraray Co. Ltd.; Gohsenol NL-05, NM-11, NM-14, AL-06, P-610, C-500, A-300, and AH-17 manufactured by Nippon Synthetic Chemical Industry Co., Ltd.; JF-04, JF-05, JF-10, JF-17, JF-17L, JM-05, JM-10, JM-17, JM-17L, JT-05, JT-13, and JT-15 manufactured by Nippon Synthetic Chemical Industry Co., Ltd.; and the like.

In addition to the polyvinylalcohols above, acid-modified polyvinylalcohols are used suitably in the invention. Preferable examples thereof include carboxy-modified polyvinylalcohols (such as itaconic acid- or maleic acid-modified polyvinylalcohols) and sulfonic acid-modified polyvinylalcohols. More preferably, these acid-modified polyvinylalcohols also have a saponification degree of 91 mol % or more.

Specific acid-modified polyvinylalcohols include KL-118, KM-618, KM-118, SK5102, MP-102, and R2105 manufactured by Kuraray Co. Ltd.; GOHSERAN CKS-50, T-HS-1, T-215, T-350, T-330, and T-330H manufactured by Nippon Synthetic Chemical Industry Co., Ltd.; AF-17 and AT-17 manufactured by Nippon Synthetic Chemical Industry Co., Ltd.; and the like.

Considering the sensitivity of the obtained planographic printing plate precursor and the adhesiveness when multiple planographic printing plate precursors are stacked, the binder contained in the protective layer is preferably in an range of 45 to 95% by mass, more preferably in a range of 50 to 90% by mass, with respect to the total solid content in the protective layer.

The protective layer preferably contains at least one binder, and may contain two or more of them. Also when multiple binders are used, the total amount thereof is preferably in the range above.

(Formation of Protective Layer)

The protective layer according to the invention is formed by coating a protective layer-coating solution, a blend of the filler and the binder above, on the oxygen barrier layer described below.

Known additives, such as a surfactant for improvement in coatability and a water-soluble plasticizer for improvement in the physical properties of film, may be added to the protective layer-coating solution. Examples of the water-soluble plasticizers include propionamide, cyclohexanediol, glycerol, sorbitol and the like. In addition, a water-soluble (meth)acrylic polymer may be added. Further, known additives for improvement in the adhesiveness of the protective layer to the support side layer and the storability of coating solution may be added to the coating solution.

The method of forming the protective layer according to the invention is not particularly limited, and the methods described in U.S. Pat. No. 3,458,311 and JP-A No. 55-49729 may be used.

The coating amount of the protective layer according to the invention (coated amount after drying) is preferably 0.1 to 4.0 $g/m^2$, and more preferably 0.3 to 3.0 $g/m^2$, from the viewpoints of film strength, abrasion resistance, maintaining image quality, and also for preservation of favorable oxygen permeability characteristics that provide favorable safelight durability.

<Oxygen Barrier Layer>

The planographic printing plate precursor according to the invention includes an oxygen barrier layer between the protective layer described above and the photosensitive layer described below. Presence of the oxygen barrier layer leads to sufficient blocking of oxygen from outside and thus to efficiently control of permeation of oxygen, a cause of polymerization inhibition, allowing prevention of deterioration in the curing reaction, and thus, giving a high-quality image without the image-forming defects often generated in the filler-present areas and portions in the exposed portion where image is missing.

The oxygen permeability of the oxygen barrier layer is preferably 0.5 to 50 $ml/m^2 \cdot day$, more preferably 0.5 to 30 $ml/m^2 \cdot day$, at 25° C. and 60% RH.

The oxygen permeability of the oxygen barrier layer is measured in the following manner.

An oxygen barrier layer coating solution is applied on a photographic paper sheet with a thickness of about 200 μm coated with 20 μm of polyethylene on both surfaces to prepare a sample for the measurement. Since oxygen permeability of the photographic paper sheet is about 700 $ml/m^2 \cdot day \cdot atm$ under the following conditions, this value may be ignored in the measurement of oxygen permeability of the oxygen barrier layer. Oxygen permeability ($ml/m^2 \cdot day \cdot atm$) of the oxygen barrier layer is measured at 25° C. and 60% RH using an OX-TRAN 2/20 (trade name: manufactured by Mocon Co.) according to the permeability evaluation method described in JIS K126B and ASTM D3985.

The oxygen permeability of the oxygen barrier layer can be controlled by adjusting the kinds or contents of the binder polymer and/or other polymers, adding an inorganic lamellar compound or an oxygen permeability-controlling agent, or by combination of these methods.

The oxygen barrier layer according to the invention is preferably a layer containing a binder polymer, an inorganic lamellar compound, and an oxygen permeability controlling agent. Hereinafter, the components which may be contained in the oxygen barrier layer will be described respectively.

(Binder Polymer)

The binder polymer that may be contained in the oxygen barrier layer is a water-soluble polymer compound similar to that contained in the protective layer. It is particularly preferably a polyvinylalcohol, from the viewpoint of oxygen blockage.

Among the polyvinylalcohol, a polyvinylalcohol having a saponification degree of 91 mol % or more (hereinafter, sometimes referred to as "specific polyvinylalcohol") is preferably used.

Examples of the polyvinylalcohol for use in the oxygen barrier layer preferable from the viewpoint of printing efficiency include itaconic acid- and maleic acid-modified carboxy-modified polyvinylalcohols, sulfonic acid-modified polyvinylalcohols, and the like. These acid-modified polyvinylalcohols also more preferably have a saponification degree of 91 mol % or more.

Examples of the acid-modified polyvinylalcohols preferable as the specific polyvinylalcohol include KL-118, KM-618, KM-118, SK-5102, MP-102, and R-2105 manufactured by Kuraray Co. Ltd.; Gohsenal T-HS-1, T-215, T-350, T-330, and T-330H manufactured by Nippon Synthetic Chemical Industry Co., Ltd.; AF-17 and AT-17 manufactured by Japan VAM & POVAL Co., Ltd.; and the like.

The content of the binder polymer that may be contained in the oxygen barrier layer is preferably in the range of 45 to 95% by mass, more preferably in the range of 50 to 90% by mass, with respect to the total solid content contained in the oxygen barrier layer. A content of less than 45% by mass may result in insufficient film-forming properties and in a reduction in sensitivity. Alternatively, a content of more than 95% by mass leads to deterioration of the efficiency with which adhesion between stacked planographic printing plate precursors may be prevented.

The oxygen barrier layer preferably contains at least one binder polymer, and alternatively, may contain multiple binder polymers. When multiple binder polymers are used, the total content thereof is preferably in the range above.

(Inorganic Lamellar Compound)

The oxygen barrier layer according to the invention may contain an inorganic lamellar compound, and preferably, contains polyvinylalcohol having a saponification degree of 91 mol % or more and an inorganic lamellar compound.

Addition of an inorganic lamellar compound to the oxygen barrier layer further improves the oxygen blocking property thereof and also the rigidity of the oxygen barrier layer. As a result, the oxygen barrier layer improves the oxygen blocking property and prevents degradation and scratching, for example by deformation.

—Mica Compound—

Examples of the inorganic lamellar compounds include mica compounds such as natural and synthetic micas represented by the following Formula:

$$A(B,C)_2\text{-}5D_4O_{10}(OH,F,O)_2 \qquad \text{Formula}$$

[wherein, A is K, Na, or Ca; each of B and C is Fe(II), Fe(III), Mn, Al, Mg, or V; and D is Si or Al], and the like.

Specific examples of the micas represented by the Formula above and other micas for use in the invention include white mica, soda mica, phlogopite, black mica, and scaly mica. Examples of the synthetic micas include non-swelling micas such as fluorine phlogopite $KMg_3(AlSi_3O_{10})F_2$ and potassium tetrasilicic mica $KMg_{2.5}(Si_4O_{10})F_2$; and swelling micas such as Na tetrasilicic mica $NaMg_{2.5}(Si_4O_{10})F_2$, Na or Liteniolite $(Na,Li)Mg_2Li(Si_4O_{10})F_2$, and montmorillonite-based Na or Li hectolight $(Na,Li)_{1/8}Mg_{2/5}Li_{1/8}(Si_4O_{10})F_2$; and the like. Synthetic smectites are also useful.

In the invention, fluorine-based swelling micas are particularly useful among the mica particles above. The swelling synthetic mica has a layer structure having a unit crystal lattice layer of approximately 1 to 1.5 nm (10 to 15 Å) in thickness, and allows substitution of the metal atoms in the lattice significantly easier than other clay minerals. As a result, the lattice layer becomes deficient in the amount of positive charges and absorbs cations such as $Li^+$, $Na^+$, $Ca^{2+}$ or $Mg^{2+}$ into the space between the layers to compensate the deficiency. The interlayer cation, which is called exchangeable cation, can be replaced with various cations. In particular when the interlayer cation is $Li^+$ or $Na^+$, the mica swells significantly in the presence of water, because the bond between lamellar crystal lattices is weaker due to the small ionic radius of the interlayer cation. Thus, the mica is easily cleaved when a shear is applied in the state, giving a sol stabilized in water. Swelling synthetic micas have such a tendency more strongly, and thus, are useful and used particularly preferably in the invention.

As for the shape of the mica compound, the thickness is preferably as thin as possible from the viewpoint of suppressing scattering, and the plane size is preferably as large as possible, as long as the smoothness of the coated surface or the transmission of activated light is not impaired. Thus, the aspect ratio is 20 or more, preferably 100 or more, and particularly preferably 200 or more. The aspect ratio is a ratio of the thickness to the length of particle, and is determined, for example, from the projected drawing of the particles in a micrograph. The greater the aspect ratio the greater the advantageous effect obtained.

The mica particles for use preferably have a size with an average major axis of 0.3 to 20 μm, more preferably 0.5 to 10 μm, and particularly preferably 1 to 5 μm. The average thickness of the mica particle is preferably 0.1 μm or less, more preferably 0.05 μm or less, and particularly preferably 0.01 μm or less. Specifically, the size of a typical compound, a swelling synthetic mica, has a thickness of 1 to 50 nm and a plane size (major axis) of approximately 1 to 20 μm.

The content of the inorganic lamellar compound such as mica compound in the oxygen barrier layer is preferably in the range of 5 to 50% by mass, more preferably in the range of 10 to 40% by mass, with respect to the total solid content in the oxygen barrier layer, for prevention of adhesion between stacked planographic printing plate precursors, scratching thereof, and reduction in sensitivity during laser exposure and for preservation of low oxygen permeability. Even when multiple kinds of mica particles are used, the total amount of these mica particles is preferably in the above ranges by mass.

(Oxygen Permeability Controlling Agent)

As a method for controlling the oxygen permeability in the oxygen barrier layer, another water-soluble polymer, may be added as an oxygen permeability controlling agent, in combination with the polyvinylalcohol favorable as a binder polymer.

Examples of the other water-soluble polymers include polyvinylpyrrolidone, polyethylene glycol, soluble starch, carboxymethylcellulose, hydroxyethylcellulose, and copolymer compounds of ethyleneoxide and propyleneoxide.

Particularly preferable are the compounds represented by the following Formula (A):

$$HO—(CH_2CH_2O)_a(C_3H_6O)_b(CH_2CH_2O)_c—H \qquad \text{Formula (A)}$$

(in Formula (A), a denotes an integer of 1 to 100; b denotes an integer of 1 to 100; and c denotes an integer of 1 to 100.)

The content of the oxygen permeability-controlling agent in the oxygen barrier layer is preferably 0.5 to 20% by mass, more preferably 1 to 10% by mass, with respect to the total solid content in the oxygen barrier layer.

(Formation of Oxygen Barrier Layer)

The oxygen barrier layer according to the invention is formed by coating an oxygen barrier layer coating solution containing the components for the layer on the photosensitive layer described below.

Known additives, such as a surfactant for improvement in coatability and a water-soluble plasticizer for improvement in film physical properties, may be added to the oxygen barrier layer coating solution. Examples of the water-soluble plasticizers include propionamide, cyclohexanediol, glycerol, sorbitol and the like. Alternatively, a water-soluble (meth)acrylic polymer may be added. In addition, known additives for improvement in the adhesiveness thereof to the layer formed on the support side surface of the oxygen barrier layer and also of stability of the coating solution may be added to the coating solution.

The method of forming the oxygen barrier layer according to the invention is not particularly limited, and examples thereof include those described in U.S. Pat. No. 3,458,311 and JP-A No. 55-49729.

The coating amount of the oxygen barrier layer (coating amount after drying) is preferably 0.1 to 4.0 g/m$^2$, and more preferably 0.3 to 3.0 g/m$^2$, for preservation of film strength, abrasion resistance, maintaining image quality, and oxygen permeability favorable to exhibit safelight durability.

<Photosensitive Layer>

Hereinafter, the photosensitive layer in the negative-type planographic printing plate precursor according to the invention will be described.

The invention is characterized in that there is an image-forming photosensitive layer containing a polymerizable compound (A) formed between the support and the oxygen barrier layer. The photosensitive layer preferably contains additionally a polymerization initiator (B), an infrared absorbent (C) having an absorption maximum of 700 to 1,300 nm or a sensitizer (C') having an absorption maximum of 300 to 600 nm.

Hereinafter, the components for the photosensitive layer will be described respectively.

[Polymerizable Compound (A)]

The polymerizable compound (A) is a radical-polymerizable compound having at least one ethylenic unsaturated double bond and selected from compounds having at least one, preferably two or more, terminal ethylenic unsaturated bond. These compounds are widely known in the art, and any one of them may be used in the first embodiment without particular restriction. These compounds are present in various chemical structures, for example in the form of monomer, prepolymer (such as dimer, trimer or oligomer, or the mixture thereof), and the copolymer thereof. Examples of the monomers and the copolymers thereof include unsaturated carboxylic acids (such as acrylic acid, methacrylic acid, itaconic acid, crotonic acid, isocrotonic acid, and maleic acid) and the esters and amides thereof, and preferable examples thereof include esters of an unsaturated carboxylic acid and an aliphatic polyvalent alcohol compound and amides of an unsaturated carboxylic acid and aliphatic polyvalent amine compound. In addition, addition reaction products of an unsaturated carboxylic ester or an amide having a nucleophilic substituent such as hydroxyl, amino, or mercapto group with a monofunctional or multifunctional isocyanate or epoxy compound, and dehydration condensation products thereof with a monofunctional or polyfunctional carboxylic acid, and the like are also used favorably. Addition reaction products of an unsaturated carboxylic ester or amide having an electrophilic substituent such as isocyanate or epoxy group with a monofunctional or polyfunctional alcohol, amine, or thiol and substitution reaction products of an unsaturated carboxylic ester or amide having a leaving substitution group such as a halogen or tosyloxy group with a monofunctional or polyfunctional alcohol, amine, or thiol are also preferable.

Other preferable examples include compounds in which the unsaturated carboxylic acid is replaced with an unsaturated phosphonic acid, styrene, or the like.

Specific examples of the radical-polymerizable compounds, which are the esters of an aliphatic polyvalent alcohol compound and an unsaturated carboxylic acid, include acrylic esters such as ethylene glycol diacrylate, triethylene glycol diacrylate, 1,3-butanediol diacrylate, tetramethylene glycol diacrylate, propylene glycol diacrylate, neopentylglycol diacrylate, trimethylolpropane triacrylate, trimethylolpropane tri(acryloyloxypropyl)ether, trimethylolethane triacrylate, hexanediol diacrylate, 1,4-cyclohexanediol diacrylate, tetraethylene glycol diacrylate, pentaerythritol diacrylate, pentaerythritol triacrylate, pentaerythritol tetraacrylate, dipentaerythritol diacrylate, dipentaerythritol hexaacrylate, sorbitol triacrylate, sorbitol tetraacrylate, sorbitol pentaacrylate, sorbitol hexaacrylate, tri(acryloyloxyethyl)isocyanurate, polyester acrylate oligomers, and the like; methacrylic esters such as tetramethylene glycol dimethacrylate, triethylene glycol dimethacrylate, neopentylglycol dimethacrylate, trimethylolpropane trimethacrylate, trimethylolethane trimethacrylate, ethylene glycol dimethacrylate, 1,3-butanediol dimethacrylate, hexanediol dimethacrylate, pentaerythritol dimethacrylate, pentaerythritol trimethacrylate, pentaerythritol tetramethacrylate, dipentaerythritol dimethacrylate, dipentaerythritol hexamethacrylate, sorbitol trimethacrylate, sorbitol tetramethacrylate, bis [p-(3-methacryloxy-2-hydroxypropoxy)phenyl]dimethyl methane, bis-[p-(methacryloxyethoxy)phenyl]dimethyl methane, and the like; itaconate esters such as ethylene glycol diitaconate, propylene glycol diitaconate, 1,3-butanediol diitaconate, 1,4-butanediol diitaconate, tetramethylene glycol diitaconate, pentaerythritol diitaconate, sorbitol tetraitaconate, and the like; crotonate esters such as ethylene glycol dicrotonate, tetramethylene glycol dicrotonate, pentaerythritol dicrotonate, sorbitol tetradicrotonate, and the like; isocrotonate esters such as ethylene glycol diisocrotonate, pentaerythritol diisocrotonate, sorbitol tetraisocrotonate, and the like; and maleate esters such as ethylene glycol dimalate, triethylene glycol dimalate, pentaerythritol dimalate, sorbitol tetramalate, and the like.

Examples of other esters favorably used include the aliphatic alcohol-based esters described in JP-B No. 46-27926, JP-B No. 51-47334, JP-A No. 57-196231; the aromatic skeleton-containing esters described in JP-A No. 59-5240, JP-A No. 59-5241, JP-A No. 2-226149; the amino group-containing esters described in JP-A No. 1-165613; and the like.

Specific examples of the amide monomer consisting of an aliphatic polyvalent amine compound and an unsaturated carboxylic acid include methylene bis-acrylamide, methylene bis-methacrylamide, 1,6-hexamethylene bis-acrylamide, 1,6-hexamethylene bis-methacrylamide, diethylenetriamine trisacrylamide, xylylene bisacrylamide, xylylene bis-methacrylamide, and the like.

Examples of other preferable amide monomers include the monomers having a cyclohexylene structure described in JP-B No. 54-21726.

Urethane-based addition-polymerizable compounds produced in addition reaction between an isocyanate and a hydroxyl group are also preferable, and specific examples thereof include the vinyl urethane compounds containing two or more polymerizable vinyl groups in the molecule, which are produced by addition of a polyisocyanate compound having two or more isocyanate groups in the molecule and a hydroxyl group-containing vinyl monomer represented by the following Formula (D), described in JP-B No. 48-41708.

$$CH_2{=}C(R)COOCH_2CH(R')OH \qquad \text{Formula (D)}$$

(Wherein, R and R' each represent H or $CH_3$.)

Also preferable are the urethane acrylates described in JP-A No. 51-37193 and JP-B Nos. 2-32293 and 2-16765; and the urethane compounds having an ethylene oxide skeleton described in JP-B Nos. 58-49860, 56-17654, 62-39417, and 62-39418.

In addition, the radical-polymerizable compounds having a amino or sulfide structure in the molecule described in JP-A No. 63-277653, JP-A No. 63-260909, JP-A No. 1-105238 are also used favorably.

Other preferable examples thereof include polyfunctional acrylates and methacrylates such as the polyester acrylates and epoxyacrylates obtained in reaction of an epoxy resin with acrylic acid or methacrylic acid described in JP-A No. 48-64183, and JP-B Nos. 49-43191 and 52-30490. Still another examples thereof include the particular unsaturated compounds described in JP-B Nos. 46-43946, 1-40337, and 1-40336, the vinylphosphonic acid compounds described in JP-A No. 2-25493, and the like. In addition, the structures containing a perfluoroalkyl group described in JP-A No. 61-22048 are used favorably in some cases. Further, the photo-curing monomers and oligomers described in J. Adhesion Soc. Jpn. Vol. 20, No. 7, pp. 300-308 (1984) are also used favorably.

In the invention, the polymerizable compounds (A) may be used alone or in combination of two or more. Details of using such a polymerizable compound, such as structure, single or combined use, and addition amount, are determined arbitrarily according to the desirable characteristics of the final recording material.

The higher the content of the polymerizable compound (A) in the photosensitive layer the better from the point of sensitivity, however an excessively higher content may cause problems such as generation of unfavorable phase separation, problems in production due to the adhesiveness of the photosensitive layer (e.g., production defects due to transfer or adhesion of photosensitive layer components) and precipitation in the developing solution.

Thus from these viewpoints, the ratio of the content of the polymerizable compound (A) is preferably 5 to 95% by mass, more preferably 10 to 85% by mass, with respect to the total solid content in the photosensitive layer.

The method of using the polymerizable compound (A), specifically the structure, blending, and addition amount thereof, may be selected according to the desired properties; and furthermore layer structures and application methods having additional undercoat and topcoat layers may also be used favorably.

[Polymerization Initiator (B)]

In the invention, it is preferable to add a polymerization initiator generating radicals by light or heat as the component (B).

The component (B) in the invention is a compound generating radicals by light or heat, initiating polymerization reaction of the radical-polymerizable compound, and accelerating the polymerization reaction, depending on the reaction mechanism of the compound.

Examples of the components (B) include (a) aromatic ketones, (b) onium salt compounds, (c) organic peroxides, (d) thio compounds, (e) hexaarylbiimidazole compounds, (f) ketoxime ester compounds, (g) borate compounds, (h) azinium compounds, (i) metallocene compounds, 0) active ester compounds, (k) carbon halogen bond-containing compounds and the like. Hereinafter, specific examples of the compounds (a) to (k) will be described, however the invention is not limited thereto.

(a) Aromatic Ketones

Preferable examples of the aromatic ketones (a) include the compounds having a benzophenone or thioxanthone skeleton described in "Radiation Curing Polymer Science and Technology" J. P. Fouassier and J. F. Rabek (1993), pp. 77-117, and the like. Examples thereof include the following compounds:

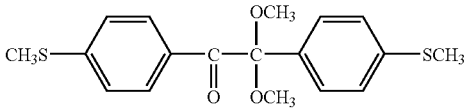

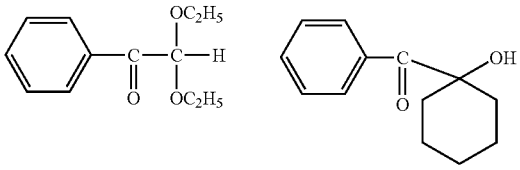

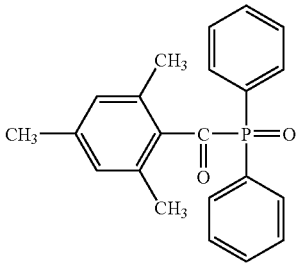

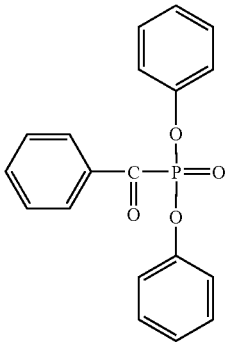

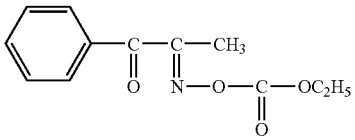

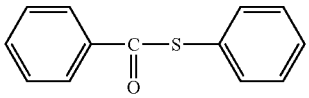

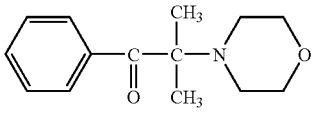

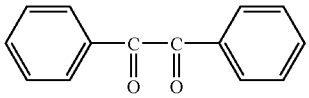

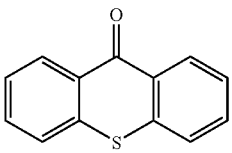

-continued

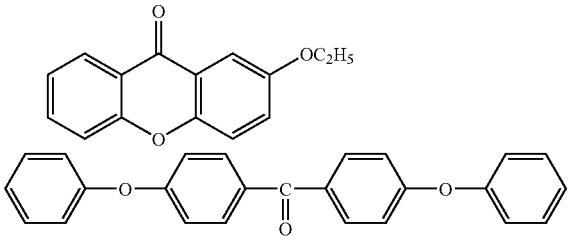

Among them, particularly preferable examples of the aromatic ketones (a) include the α-thiobenzophenone compound described in JP-B No. 47-6416 and the benzoin ether compounds described in JP-B No. 47-3981, such as that shown below:

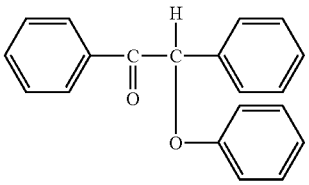

and, the α-substituted benzoin compound described in JP-B No. 47-22326 such as that shown below:

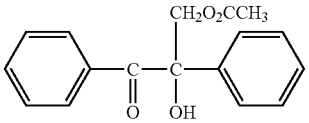

the benzoin derivatives described in JP-B No. 47-23664, the aroylphosphonate esters described in JP-A No. 57-30704, and the dialkoxybenzophenones described in JP-B No. 60-26483, such as the following compound:

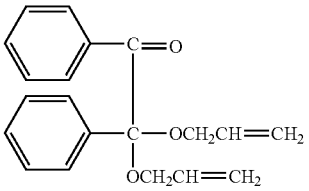

the benzoin ethers described in JP-B No. 60-26403 and JP-A No. 62-81345 such as the following compounds:

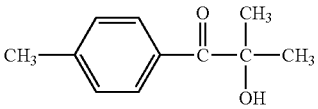

the α-aminobenzophenones described in JP-B No. 1-34242, U.S. Pat. No. 4,318,791, EP No. 0284561A1, such as the following compounds:

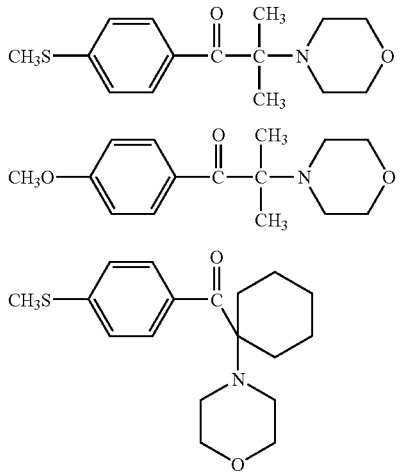

the p-di(dimethylaminobenzoyl)benzene described in JP-A No. 2-211452 such as the following compounds:

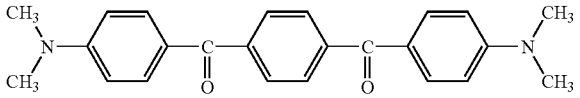

JP-A No. 61-194062 described in thio-substituted aromatic ketone, Examples thereof include the following compounds:

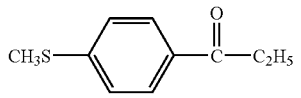

the acylphosphine sulfides described in JP-B No. 2-9597 such as the following compounds:

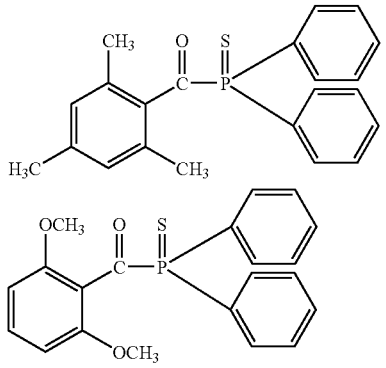

the acylphosphines described in JP-B No. 2-9596 such as the following compounds:

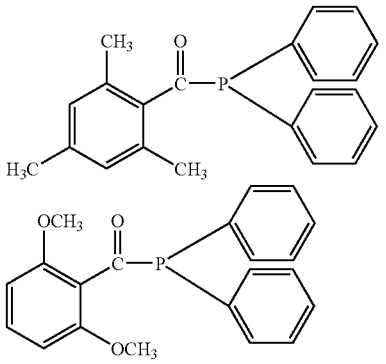

the thioxanthones described in JP-B No. 63-61950 and the coumarins described in JP-B No. 59-42864, and the like.

(b) Onium Salt Compound

Examples of the onium salt compounds (b) include the compounds represented by the following Formulae (I) to (III):

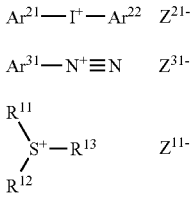

Formula (I)

Formula (II)

Formula (III)

In Formula (I), $Ar^1$ and $Ar^2$ each independently represent an aryl group having 20 or less carbon atoms which may have one or more substituents. Preferable examples of the substituents of the aryl group when present include halogen atoms, a nitro group, alkyl groups having 12 or less carbon atoms, alkoxy groups having 12 or less carbon atoms, and aryloxy groups having 12 or less carbon atoms. $(Z^2)^-$ represents a counter ion selected from the group consisting of halides, perchlorate, carboxylate, tetrafluoroborate, hexafluorophosphate, and sulfonate ions and is preferably a perchlorate, hexafluorophosphate, or aryl sulfonate ion.

In Formula (II), $Ar^3$ represents an aryl group having 20 or less carbon atoms which may have one or more substituents. Preferable examples of the substituent groups, when the aryl group may be substituted, include halogen atoms, a nitro group, alkyl groups having 12 or less carbon atoms, alkoxy groups having 12 or less carbon atoms, aryloxy groups having 12 or less carbon atoms, alkylamino groups having 12 or less carbon atoms, dialkylamino groups having 12 or less carbon atoms, arylamino groups having 12 or less carbon atoms, and diarylamino groups having 12 or less carbon atoms. $(Z^3)^-$ represents the same counter ion as $(Z^2)^-$ in Formula (I).

In Formula (III), $R^{23}$, $R^{24}$ and $R^{25}$ each independently represent a hydrocarbon group having 20 or less carbon atoms which may have one or more substituents. Preferable examples of the substituent groups when the hydrocarbon group is substituted, include halogen atoms, a nitro group, alkyl groups having 12 or less carbon atoms, alkoxy groups having 12 or less carbon atoms, and aryloxy groups having 12 or less carbon atoms. $(Z^4)^-$ represents the same counter anion as $(Z^2)^-$.

Specific examples of the onium salts favorably used in the invention include those described in JP-A No. 2001-133969, paragraph numbers (0030) to (0033) and JP-A No. 2001-343742, paragraph numbers (0015) to (0046) filed earlier by the applicant.

The onium salt for use in the invention preferable has a maximum absorption wavelength of 400 nm or less, more preferably 360 nm or less. It becomes possible to process the planographic printing plate precursor under white light, by reducing the absorption wavelength into the ultraviolet ray range.

(c) Organic Peroxide

The organic peroxides (c) described above include almost all organic compounds having one or more oxygen-oxygen bonds in the molecule; and examples thereof include methylethylketone peroxide, cyclohaxanone peroxide, 3,3,5-trimethylcyclohaxanone peroxide, methylcyclohaxanone peroxide, acetylacetone peroxide, 1,1-bis(tert-butylperoxy)-3,3,5-trimethyl cyclohexane, 1,1-bis(tert-butylperoxy) cyclohexane, 2,2-bis(tert-butylperoxy)butane, tert-butyl hydroperoxide, cumene hydroperoxide, diisopropylbenzene hydroperoxide, paramethane hydroperoxide, 2,5-dimethylhexane-2,5-dihydroperoxide, 1,1,3,3-tetramethylbutyl hydroperoxide, di-tert-butyl peroxide, tert-butylcumyl peroxide, dicumyl peroxide, bis(tert-butylperoxyisopropyl)benzene, 2,5-dimethyl-2,5-di(tert-butylperoxy)hexane, 2,5-xanoyl peroxide, persuccinic acid, benzoyl peroxide, 2,4-dichlorobenzoyl peroxide, meta-toluoyl peroxide, diisopropyl peroxydicarbonate, di-2-ethylhexyl peroxydicarbonate, di-2-ethoxyethyl peroxydicarbonate, dimethoxyisopropyl peroxycarbonate, di(3-methyl-3-methoxybutyl)peroxydicarbonate, tert-butyl peroxyacetate, tert-butyl peroxypivalate, tert-butyl peroxyneodecanoate, tert-butyl peroxyoctanoate, tert-butyl peroxy-3,5,5-trimethylhexanoate, tert-butyl peroxylaurate, tertiary carbonate, 3,3'4,4'-tetra-(t-butylperoxycarbonyl)benzophenone, 3,3'4,4'-tetra-(t-amylperoxycarbonyl)benzophenone, 3,3'4,4'-tetra-(t-hexylperoxycarbonyl)benzophenone, 3,3'4,4'-tetra-(t-octyl peroxycarbonyl)benzophenone, 3,3'4,4'-tetra-(cumylperoxycarbonyl)benzophenone, 3,3'4,4'-tetra-(p-isopropylcumylperoxycarbonyl)benzophenone, carbonyl-di(t-butylperoxy dihydrogen diphthalate), carbonyl-di(t-hexylperoxy dihydrogen diphthalate), and the like.

Among them, peroxidated ester-based compounds such as 3,3'4,4'-tetra-(t-butylperoxycarbonyl)benzophenone, 3,3'4,4'-tetra-(t-amylperoxycarbonyl)benzophenone, 3,3'4,4'-tetra-(t-hexylperoxycarbonyl)benzophenone, 3,3'4,4'-tetra-(t-octyl peroxycarbonyl)benzophenone, 3,3'4,4'-tetra-(cumylperoxycarbonyl)benzophenone, 3,3'4,4'-tetra-(p-isopropylcumylperoxycarbonyl)benzophenone, and di-t-butyldiperoxy isophthalate are preferable.

(d) Thio Compound

The (d) thio compounds include the compounds having the structure represented by the following Formula (IV):

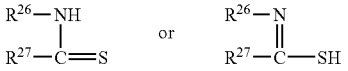

Formula (IV)

In Formula (IV), $R^{26}$ represents a hydrogen atom or an alkyl, aryl, or substituted aryl group; and $R^{27}$ represents a hydrogen atom or an alkyl group. Alternatively, $R^{26}$ and $R^{27}$ represent non-metal atom groups that bind to each other, forming a five- to seven-membered ring containing one or more heteroatoms selected from oxygen, sulfur and nitrogen atoms.

The alkyl group in Formula (IV) above is preferably an alkyl group having 1 to 4 carbon atoms. In addition, the aryl group is preferably a group having 6 to 10 carbon atoms such as phenyl and naphthyl, and preferable substituted aryl groups include the aryl groups above additionally containing one or more halogen atoms such as chlorine atom, one or more alkyl groups such as methyl group, or one or more alkoxy groups such as methoxy group and ethoxy group. Preferably, $R^{27}$ represents an alkyl group having 1 to 4 carbon atoms. Specific examples of the thio compounds represented by Formula (IV) include the following compounds:

TABLE 1

| No. | $R^{26}$ | $R^{27}$ |
|---|---|---|
| 1 | —H | —H |
| 2 | —H | —$CH_3$ |
| 3 | —$CH_3$ | —H |
| 4 | —$CH_3$ | —$CH_3$ |
| 5 | —$C_6H_5$ | —$C_2H_5$ |
| 6 | —$C_6H_5$ | —$C_4H_9$ |
| 7 | —$C_6H_4Cl$ | —$CH_3$ |
| 8 | —$C_6H_4Cl$ | —$C_4H_9$ |
| 9 | —$C_6H_4$—$CH_3$ | —$C_4H_9$ |
| 10 | —$C_6H_4$—$OCH_3$ | —$CH_3$ |
| 11 | —$C_6H_4$—$OCH_3$ | —$C_2H_5$ |
| 12 | —$C_6H_4$—$OC_2H_5$ | —$CH_3$ |
| 13 | —$C_6H_4$—$OC_2H_5$ | —$C_2H_5$ |
| 14 | —$C_6H_4$—$OCH_3$ | —$C_4H_9$ |
| 15 | —$(CH_2)_2$— | |
| 16 | —$(CH_2)_2$—S— | |
| 17 | —$CH(CH_3)$—$CH_2$—S— | |
| 18 | —$CH_2$—$CH(CH_3)$—S— | |
| 19 | —$C(CH_3)_2$—$CH_2$—S— | |
| 20 | —$CH_2$—$C(CH_3)_2$—S— | |
| 21 | —$(CH_2)_2$—O— | |
| 22 | —$CH(CH_3)$—$CH_2$—O— | |
| 23 | —$C(CH_3)_2$—$CH_2$—O— | |
| 24 | —CH=CH—$N(CH_3)$— | |
| 25 | —$(CH_2)_3$—S— | |
| 26 | —$(CH_2)_2$—$CH(CH_3)$—S— | |
| 27 | —$(CH_2)_3$—O— | |
| 28 | —$(CH_2)_5$— | |
| 29 | —$C_6H_4$—O— | |
| 30 | —N=$C(SCH_3)$—S— | |
| 31 | —$C_6H_4$—NH— | |
| 32 | 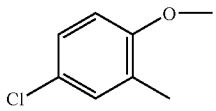 | |

(e) Hexaarylbiimidazole Compound

The hexaarylbiimidazole compounds (e) include the Rofin dimers described in JP-B Nos. 45-37377 and 44-86516, such as 2,2'-bis(o-chlorophenyl)-4,4',5,5'-tetraphenylbiimidazole,
2,2'-bis(o-bromophenyl)-4,4',5,5'-tetraphenylbiimidazole,
2,2'-bis(o,p-dichlorophenyl)-4,4',5,5'-tetraphenylbiimidazole,
2,2'-bis(o-chlorophenyl)-4,4',5,5'-tetra(m-methoxyphenyl)biimidazole,
2,2'-bis(o,o'-dichlorophenyl)-4,4',5,5'-tetraphenylbiimidazole,
2,2'-bis(o-nitrophenol)-4,4',5,5'-tetraphenylbiimidazole,
2,2'-bis(o-methylphenyl)-4,4',5,5'-tetraphenylbiimidazole,
2,2'-bis(o-trifluorophenyl)-4,4',5,5'-tetraphenylbiimidazole, and the like.

(f) Ketoxime Ester Compound

The ketoxime ester compounds (f) include 3-benzyoloxyiminobutan-2-one, 3-acetoxyiminobutan-2-one, 3-propionyloxyiminobutan-2-one, 2-acetoxyiminopentan-3-one, 2-acetoxyimino-1-phenylpropan-1-one, 2-benzyoloxyimino-1-phenylpropan-1-one, 3-p-toluenesulfonyloxyiminobutan-2-one, 2-ethoxycarbonyloxyimino-1-phenylpropan-1-one and the like.

(g) Borate Compound

Examples of the borate compounds (g) include the compounds represented by the following Formula (V):

Formula (V)

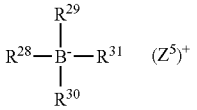

In Formula (V), $R^{28}$, $R^{29}$, $R^{30}$ and $R^{31}$ each independently represent a substituted or unsubstituted alkyl group, a substituted or unsubstituted aryl group, a substituted or unsubstituted alkenyl group, a substituted or unsubstituted alkynyl group, or a substituted or unsubstituted heterocyclic group; or two or more groups of $R^{28}$, $R^{29}$, $R^{30}$ and $R^{31}$ may bind to each other, forming a cyclic structure. However, at least one of $R^{28}$, $R^{29}$, $R^{30}$ and $R^{31}$ is a substituted or unsubstituted alkyl group. $(Z^5)^+$ represents an alkali metal cation or a quaternary ammonium cation.

The alkyl groups of $R^{28}$ to $R^{31}$ include straight-chain, branched, and cyclic alkyl groups, and those having 1 to 18 carbon atoms are preferable. Specific examples thereof include methyl, ethyl, propyl, isopropyl, butyl, pentyl, hexyl, octyl, stearyl, cyclobutyl, cyclopentyl, cyclohexyl, and the like. In addition, the substituted alkyl groups include the alkyl groups above additionally containing one or more halogen atoms (e.g., —Cl, —Br, etc.), cyano groups, nitro groups, aryl groups (preferably phenyl), hydroxy groups, —$COOR^{32}$ (wherein, $R^{32}$ represents a hydrogen atom or an alkyl or aryl group having 1 to 14 carbons), —$OCOR^{33}$ or —$OR^{34}$ (wherein, $R^{33}$ and $R^{34}$ each represents an alkyl or aryl group having 1 to 14 carbons), and the groups represented by the following formula as the substituent groups.

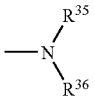

$R^{35}$ and $R^{36}$ each independently represent a hydrogen atom or an alkyl or aryl group having 1 to 14 carbons.

The aryl groups of $R^{28}$ to $R^{31}$ include monocyclic to tricyclic groups such as phenyl and naphthyl groups; and the substituted aryl groups include the aryl groups above that have additionally the substituent group for the substituted alkyl group described above or an alkyl group having 1 to 14 carbons.

The alkenyl groups of $R^{28}$ to $R^{31}$ include straight-chain, branched, and cyclic alkenyl groups having 2 to 18 carbon atoms; and the substituent groups of the substituted alkenyl group include those described as the substituent groups of the substituted alkyl group.

The alkynyl groups of $R^{28}$ to $R^{31}$ include straight-chain or branched-chain alkynyl groups having 2 to 28 carbons; and the substituent groups of the substituted alkynyl group include those described as the substituent groups of the substituted alkyl group.

Further, the heterocyclic groups of $R^{28}$ to $R^{31}$ include heterocyclic groups of five- or higher membered rings, preferably 5 to 7-membered rings, containing at least one N, S, or O atom; and the heterocyclic group may be a fused ring.

The heterocyclic groups may have additionally one of the groups described as the substituent groups of the substituted aryl group described above as their substituent group.

Specific examples of the compounds represented by Formula (V) include the compounds described in U.S. Pat. Nos. 3,567,453 and 4,343,891, and E.P. Nos. 109772 and 109773 and the compounds shown below.

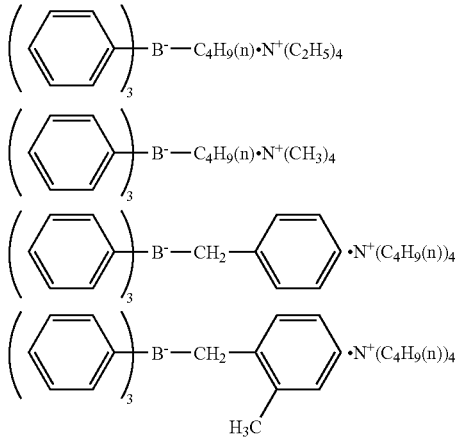

(h) Azinium Compound

The azinium salt compounds (h) include the compounds having one or more N—O bonds described in JP-A No 63-138345, 63-142345, 63-142346, and 63-143537 and JP-B No. 46-42363.

(i) Metallocene Compound

The metallocene compounds (i) include the titanocene compounds described in JP-A Nos. 59-152396, 61-151197, 63-41484, 2-249, and 2-4705; and the iron-allene complexes described in JP-A Nos. 1-304453 and 1-152109.

Specific examples of the titanocene compound s include di-cyclopentadienyl-Ti-di-chloride, di-cyclopentadienyl-Ti-bis-phenyl, di-cyclopentadienyl-Ti-bis-2,3,4,5,6-pentafluorophen-1-yl, di-cyclopentadienyl-Ti-bis-2,3,5,6-tetrafluorophen-1-yl, di-cyclopentadienyl-Ti-bis-2,4,6-trifluorophen-1-yl, di-cyclopentadienyl-Ti-2,6-difluorophen-1-yl, di-cyclopentadienyl-Ti-bis-2,4-difluorophen-1-yl, di-methylcyclopentadienyl-Ti-bis-2,3,4,5,6-pentafluorophen-1-yl, di-methylcyclopentadienyl-Ti-bis-2,3,5,6-tetrafluorophen-1-yl, di-methylcyclopentadienyl-Ti-bis-2,4-difluorophen-1-yl, bis(cyclopentadienyl)-bis(2,6-difluoro-3-(pyr-1-yl)phenyl)titanium bis(cyclopentadienyl)bis[2,6-difluoro-3-(methyl sulfonamido)phenyl]titanium, bis(cyclopentadienyl) bis[2,6-difluoro-3-(N-butyl biaroyl-amino)propylphenyl] titanium, bis(cyclopentadienyl)bis[2,6-difluoro-3-(n-butyl-(4-chlorobenzoyl)amino)propylphenyl]titanium, bis (cyclopentadienyl)bis[2,6-difluoro-3-(N-benzyl-2,2-dimethylpentanoylamino)propylphenyl]titanium, bis (cyclopentadienyl)bis[2,6-difluoro-3-(N-(2-ethylhexyl)-4-tolyl-sulfonyl)amino)propylphenyl]titanium, bis (cyclopentadienyl)bis[2,6-difluoro-3-[N-(3-oxaheptyl)

benzoylamino)propylphenyl]titanium, bis(cyclopentadienyl) bis[2,6-difluoro-3-(N-(3,6-dioxadecyl)benzoylamino) propylphenyl]titanium, bis(cyclopentadienyl)bis[2,6-difluoro-3-(trifluoromethylsulfonyl)amino)propylphenyl] titanium, bis(cyclopentadienyl)bis[2,6-difluoro-3-(trifluoroacetylamino)propylphenyl]titanium, bis (cyclopentadienyl)bis[2,6-difluoro-3-(2-chlorobenzoyl) amino)propylphenyl]titanium, bis(cyclopentadienyl)bis[2,6-difluoro-3-(4-chlorobenzoyl)amino)propylphenyl]titanium, bis(cyclopentadienyl)bis[2,6-difluoro-3-(N-(3,6-dioxa decyl)-2,2-dimethyl pentanoylamino)propylphenyl]titanium, bis(cyclopentadienyl)bis[2,6-difluoro-3-(N-(3,7-dimethyl-7-methoxyoctyl)benzoylamino)propylphenyl]titanium, bis(cyclopentadienyl)bis[2,6-difluoro-3-(N-cyclohexylbenzoylamino)propylphenyl)titanium, and the like.

(j) Active Ester Compound

The active ester compounds 0) include the imide sulfonate compounds described in JP-B No. 62-6223; the active sulfonates described in JP-B No. 63-14340 and JP-A No. 59-174831; and the like.

(k) Carbon Halogen Bond-containing Compound

The compounds having a carbon-halogen bond (k) include the following compounds represented by Formulae (VI) to (XII):

Formula (VI)

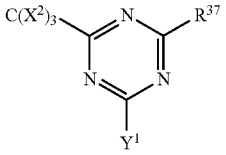

In Formula (VI), $X^2$ represents a halogen atom; and $Y^1$ represents —$C(X^2)_3$, —$NH_2$, —$NHR^{38}$, —$NR^{38}$, or —$OR^{38}$. $R^{38}$ represents an alkyl group, a substituted alkyl group, aryl group, or a substituted aryl group. In addition, $R^{37}$ represents —$C(X^2)_3$, an alkyl group, a substituted alkyl group, an aryl group, a substituted aryl group, or a substituted alkenyl group.

Formula (VII)

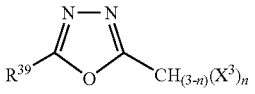

In Formula (VII), $R^{39}$ represents an alkyl, substituted alkyl, alkenyl, substituted alkenyl, aryl, or substituted aryl group, a halogen atom, an alkoxy or substituted alkoxyl group, a nitro group or a cyano group; $X^3$ represents a halogen atom; and n is an integer of 1 to 3.

$R^{40}$—$Z^5$—$CH_{(2-m)}(X^3)_mR^{41}$ Formula (VIII)

In Formula (VIII), $R^{40}$ represents an aryl or substituted aryl group; $R^{41}$ represents one of the following groups or a halogen atom; and $Z^5$ represents —C(═O)—, —C(═S)—, or —$SO_2$—.

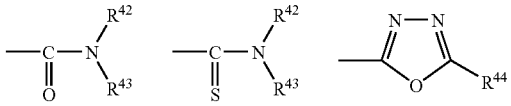

$R^{42}$ and $R^{43}$ each represent an alkyl, substituted alkyl, alkenyl, substituted alkenyl, aryl, or substituted aryl group; $R^{44}$ is the same as $R^{38}$ in Formula (IV); $X^3$ represents a halogen atom; and m is 1 or 2.

Formula (IX)

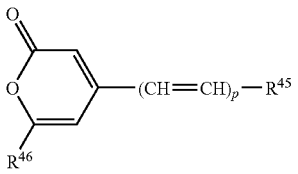

In Formula (IX), $R^{45}$ represents an aryl or heterocyclic group that may be substituted; $R^{46}$ represents a trihaloalkyl or trihaloalkenyl group having 1 to 3 carbon atoms; and p is 1, 2 or 3.

Formula (X)

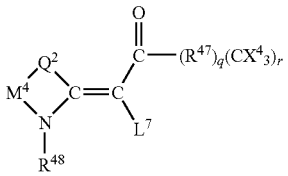

$L^7$ represents a hydrogen atom or a substituent group represented by Formula: CO—$(R^{47})_q(C(X^4)_3)_r$, wherein, $L^7$ represents a hydrogen atom or a substituent group represented by Formula: CO—$(R^{47})_q(C(X^4)_3)_r$; $Q^2$ represents a sulfur, selenium or oxygen atom, or a dialkylmethylene, alken-1,2-ylene, 1,2-phenylene, or —N—R— group; $M^4$ represents a substituted or unsubstituted alkylene, alkenylene, or 1,2-arylene group; $R^{48}$ represents an alkyl, aralkyl, or alkoxyalkyl group; $R^{47}$ represents an alicyclic or heterocyclic divalent aromatic group; $X^4$ represents a chlorine, bromine, or iodine atom; and q is 0 and r is 1; or q is 1 and r is 1 or 2.

Formula (XI)

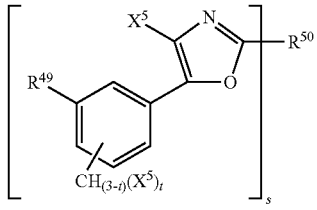

Formula (XI) represents a 4-halogeno-5-(halogenomethylphenyl)-oxazole derivative, wherein $X^5$ represents a halogen atom; t is an integer of 1 to 3; s is an integer of 1 to 4; $R^{49}$ represents a hydrogen atom or a $CH_{3-t}X^5_t$ group; and $R^{50}$ represents an unsaturated s-valent organic group that may be substituted.

Formula (XII)

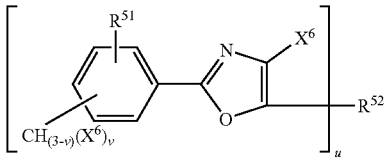

Formula (XII) represents a 2-(halogenomethyl-phenyl)-4-halogenooxazole derivative, wherein $X^6$ represents a halogen atom; v is an integer of 1 to 3; u is an integer of 1 to 4; $R^{51}$ represents a hydrogen atom or a $CH_{3-v}X^6{}_v$ group; and $R^{52}$ represent an unsaturated u-valent organic group that may be substituted.

Specific examples of the compounds having a carbon-halogen bond include the compounds described in Wakabayashi et al., Bull. Chem. Soc. Japan, 42, 2924 (1969). Specific examples of thereof include 2-phenyl-4,6-bis(trichloromethyl)-S-triazine, 2-(p-chlorophenyl)-4,6-bis(trichloromethyl)-S-triazine, 2-(p-tolyl)-4,6-bis(trichloromethyl)-S-triazine, 2-(p-methoxyphenyl)-4,6-bis(trichloromethyl)-S-triazine, 2-(2',4'-dichlorophenyl)-4,6-bis(trichloromethyl)-S-triazine, 2,4,6-tris(trichloromethyl)-S-triazine, 2-methyl-4,6-bis(trichloromethyl)-S-triazine, 2-n-nonyl-4,6-bis(trichloromethyl)-S-triazine, 2-(α,α,β-trichloroethyl)-4,6-bis(trichloromethyl)-S-triazine, and the like. Other examples thereof include the compounds described in British Patent No. 1,388,492 such as 2-styryl-4,6-bis(trichloromethyl)-S-triazine, 2-(p-methylstyryl)-4,6-bis(trichloromethyl)-S-triazine, 2-(p-methoxystyryl)-4,6-bis(trichloromethyl)-S-triazine, and 2-(p-methoxystyryl)-4-amino-6-trichloromethyl-S-triazine; the compounds described in JP-A No. 53-133428 such as 2-(4-methoxy-naphtho-1-yl)-4,6-bistrichloromethyl-S-triazine, 2-(4-ethoxynaphtho-1-yl)-4,6-bistrichloromethyl-S-triazine, 2-(4-(2-ethoxyethyl)-naphtho-1-yl)-4,6-bistrichloromethyl-S-triazine, 2-(4,7-dimethoxy-naphtho-1-yl)-4,6-bistrichloromethyl-S-triazine), and 2-(acenaphtho-5-yl)-4,6-bistrichloromethyl-S-triazine; the compounds described in Germany Patent No. 3,337,024 such as the following compounds; and the like.

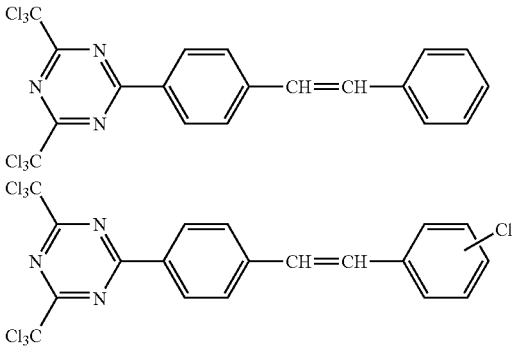

Also included are the compounds described in F. C. Schaefer et al., J. Org. Chem. 29, 1527 (1964) such as 2-methyl-4,6-bis(tribromomethyl)-S-triazine, 2,4,6-tris(tribromomethyl)-S-triazine, 2,4,6-tris(dibromomethyl)-S-triazine, 2-amino-4-methyl-6-tribromomethyl-S-triazine, and 2-methoxy-4-methyl-6-trichloromethyl-S-triazine; and the like. Further included are the compounds described in JP-A No. 62-58241 such as the following compounds:

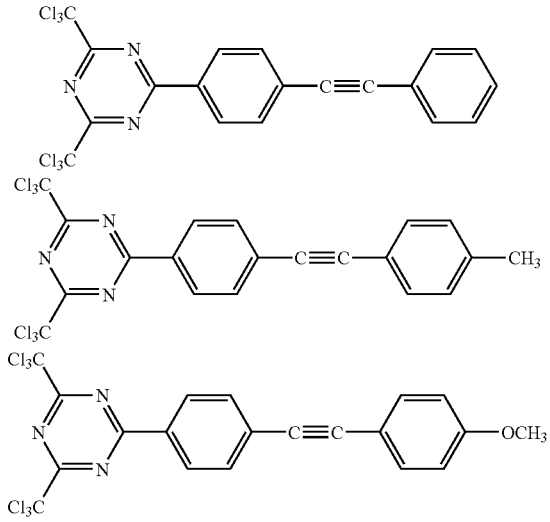

The compounds described in JP-A No. 5-281728 such as the following compounds are also included.

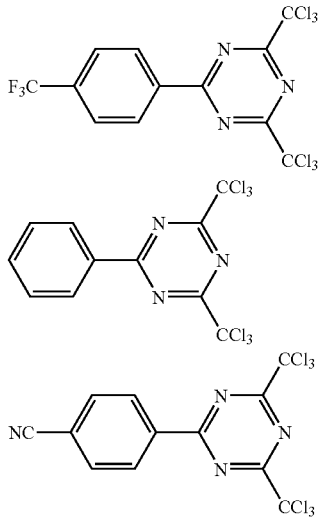

Further, the compounds that can be easily prepared by those skilled in the art according to the synthetic method described in M. P. Hutt, E. F. Elslager and L. M. Herbel., "Journal of Heterocyclic Chemistry" Vol. 7 (No. 3), pp. 511-(1970), such as the following compounds, are also included.

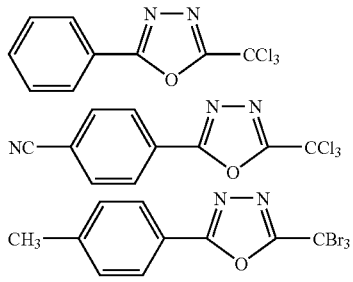

-continued

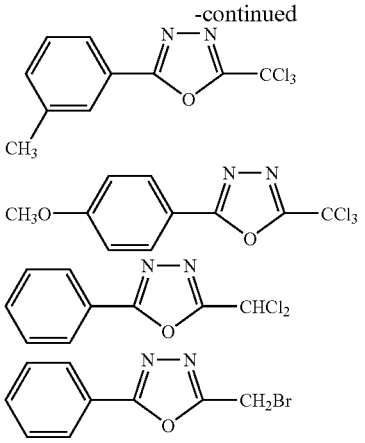

More preferable examples of the component (B) in the invention include the aromatic ketones (a), onium salt compounds (b), organic peroxides (c), hexaarylbiimidazole compounds (e), metallocene compounds (i), and carbon halogen bond-containing compounds (k) above. More preferable examples thereof include the onium salt compounds (b) including diazonium, iodonium, sulfonium, ammonium and pyridinium salts, and the hexaarylbiimidazole compounds (e), from the points of sensitivity, and, among them, iodonium and sulfonium salts are used most favorably.

The component (B) in the invention is preferably contained in an amount of 0.1 to 50% by mass, more preferably 0.5 to 30 mass and particularly preferably 5 to 20% by mass, with respect to the total solid content composing the photosensitive layer.

The components (B) in the invention may be used alone or in combination of two or more.

[Infrared Absorbent (C) Having an Absorption Maximum of 700 to 1,300 nm]

The photosensitive layer according to the invention preferably contains an infrared absorbent (C) having an absorption maximum of 700 to 1,300 nm (hereinafter, simply referred to as "infrared absorbent") when an image is formed by irradiation of infrared ray. After absorption of a light at the wavelength in the infrared region, the infrared absorbent decomposes a component (C), i.e., a compound generating a radical by heat-mode exposure of the light at an absorption wavelength of the infrared absorbent (C), and generates radials. The infrared absorbent for use in the invention is preferably a compound functioning to convert adsorbed light into heat, and is, for example, a dye or pigment in so-called infrared absorbents having the absorption maximum at the wavelength of the infrared laser used for image writing, i.e., in the wavelength range of 700 to 1,300 nm.

Examples of the dyes include commercially available dyes and those known in the art, for example, those described in "Dye Handbook" (Society of Synthetic Organic Chemistry, Japan Ed., 1970) and others. Specific examples thereof include azo dyes, metal complex salt azo dyes, pyrazolone azo dyes, naphthoquinone dyes, anthraquinone dyes, phthalocyanine dyes, carbonium dyes, quinonimine dyes, methine dyes, cyanine dyes, squalilium colorants, and dyes of pyrylium salts, and metal thiolate complexes.

Preferable examples of the dyes include the cyanine dyes described in JP-A Nos. 58-125246, 59-84356, 59-202829, and 60-78787, and others; the methine dyes described in JP-A Nos. 58-173696, 58-181690, and 58-194595, and others; the naphthoquinone dyes described in JP-A Nos. 58-112793, 58-224793, 59-48187, 59-73996, 60-52940, and 60-63744, and others; the squalilium colorants described in JP-A No. 58-112792 and others; the cyanine dyes described in British Patent No. 434875 and others; and the like.

Also favorably used are the infrared-absorbing sensitizers described in U.S. Pat. No. 5,156,938; the substituted arylbenzo(thio)pyrylium salts described in U.S. Pat. No. 3,881,924; the trimethine thiapyrylium salts described in JP-A No. 57-142645 (U.S. Pat. No. 4,327,169); the pyrylium-based compounds described in JP-A Nos. 58-181051, 58-220143, 59-41363, 59-84248, 59-84249, 59-146063, and 59-146061; the cyanine colorants described in JP-A No. 59-216146; the pentamethine thiopyrylium salts and others described in U.S. Pat. No. 4,283,475; and the pyrylium compounds described in JP-B Nos. 5-13514 and 5-19702.

Other preferable examples of the dyes include the infrared-absorbing dyes represented by Formulae (I) and (II) described in U.S. Pat. No. 4,756,993.

Particularly preferable among the dyes are cyanine dyes, squalilium dyes, pyrylium salts, and nickel thiolate complexes. Cyanine dyes are more preferable, and cyanine dyes represented by the following Formula (a) or (b) are particularly preferable.

Formula (a)

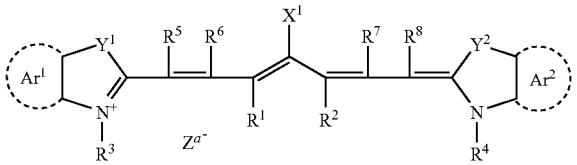

In Formula (a), $X^1$ represents a halogen atom or —$X^2$-$L^1$. $X^2$ represents an oxygen or sulfur atom; and $L^1$ represents a hydrocarbon group having 1 to 12 carbon atoms. $R^1$ and $R^2$ each independently represent a hydrocarbon group having 1 to 12 carbon atoms. From the point of the storage stability of image recording layer coating solution, $R^1$ and $R^2$ each preferably represent a hydrocarbon group having two or more carbon atoms; and particularly preferably, $R^1$ and $R^2$ bind to each other, forming a five- or six-membered ring.

$Ar^1$ and $Ar^2$ may be the same or different from each other, and each of them represents an aromatic hydrocarbon group which may be substituted. Preferable aromatic hydrocarbon groups include benzene and naphthalene rings. Preferable substituent groups include hydrocarbon groups having 12 or fewer carbon atoms, halogen atoms, and alkoxy groups having 12 or fewer carbon atoms. $Y^1$ and $Y^2$ may be the same or different from each other, and each of them represents a sulfur atom or a dialkylmethylene group having 12 or fewer carbon atoms. $R^3$ and $R^4$ may be the same or different from each other, and each of them represents a hydrocarbon group having 20 or fewer carbon atoms that may be substituted. Preferable substituent groups thereon include alkoxy groups having 12 or fewer carbon atoms, a carboxyl group, and a sulfo group. $R^5$, $R^6$, $R^7$ and $R^8$ may be the same or different from each other, and each of them represents a hydrogen atom or a hydrocarbon group having 12 or fewer carbon atoms. The group is preferably a hydrogen atom, from the point of availability of the raw material. However, when the cyanine colorant represented by Formula (a) has an anionic substituent group in the structure and there is no need for neutralization of the electric charge, $Z_a^-$ is unnecessary. Preferably from the point of the storage stability of image recording layer-coating solution, $Z_a^-$ represents a halide, perchlorate, tetrafluoroborate, hexafluorophosphate, or sulfonate ion, particularly preferably a perchlorate, hexafluorophosphate, or arylsulfonate ion.

Formula (b)

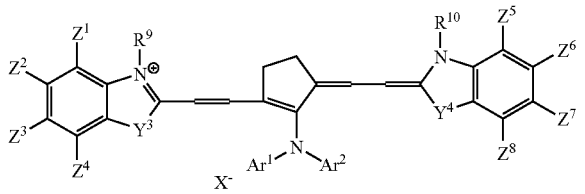

In Formula (b), $R^9$ and $R^{10}$ each independently represent a straight-chain or branched alkyl group having 20 or less carbon atoms that may be substituted with a group selected from the group consisting of aryl, alkenyl, alkoxy, hydroxyl, sulfo, carboxy, and acyloxy groups. $Ar^1$ and $Ar^2$ each independently represent a hydrogen atom, an alkyl group having 1 to 4 carbon atoms or an aryl group having 6 to 10 carbon atoms; when it is an alkyl or aryl group, the group may be substituted with a substituent group selected from alkyl and aryl groups and halogen atoms; and $Ar^1$ and $Ar^2$ may bind to each other. $Y^3$ and $Y^4$ may be the same as or differ from each other; and each of them represents a sulfur, oxygen, or selenium atom, a dialkylmethylene group having 12 or fewer carbon atoms, or a —CH=CH— group. $Z^1$ to $Z^8$ may be the same as or differ from each other, and each of them represents a hydrogen atom, a hydrocarbon group, an oxy group, or electron-withdrawing group or heavy atom-containing substituent group; at least one group among them represents an electron-withdrawing substituent group or a heavy atom-containing substituent group; and neighboring two substituent groups of $Z^1$ to $Z^8$ may bind to each other, forming a five- or six-membered ring. $X^-$ represents $CF_3SO_3^-$.

Specific examples of the cyanine dyes represented by Formula (a) favorably used in the invention include those described in JP-A No. 2001-133969, paragraph numbers (0017) to (0019). Specific examples of the cyanine colorants represented by Formula (b) include those described in JP-A No. 2002-278057, paragraph numbers (0034) to (0041).

Examples of the pigments for use in the invention include commercially available pigments and the pigments described in Color Index (C.I.) Handbook, "Pigment Handbook" (Japan Society of pigment technologies Ed., 1977), "State-of-the-Art Pigment Application Technologies" (CMC Publishing Co., Ltd., 1986), and "Printing Ink Technology" (CMC Publishing Co., Ltd., 1984).

Examples of the pigments include black pigments, yellow pigments, orange pigments, brown pigments, red pigments, purple pigments, blue pigments, green pigments, fluorescent pigments, metal powder pigments, as well as polymer-bound colorants. Specific examples thereof include insoluble azo pigments, azolake pigments, condensation azo pigments, chelate azo pigments, phthalocyanine-based pigments, anthraquinone-based pigments, perylene-based and perynone-based pigments, thioindigo-based pigments, quinacridone-based pigments, dioxazine-based pigments, isoindolinone-based pigments, quinophtharone-based pigments, dyed lake-based pigments, azine-based pigments, nitroso pigments, nitro pigments, natural pigments, fluorescent pigments, inorganic pigments, carbon black, and the like. Among these pigments, preferable is carbon black.

These pigments may be used either with or without surface treatment. Examples of the surface treatment methods include methods of coating a resin or wax on the surface of pigment; of attaching a surfactant thereon; of binding a reactive substance (e.g., silane coupling agent, epoxy compound, polyisocyanate, or the like) to the surface of pigment; and the like. The surface treatment methods above are described in "Properties and Applications of Metal Soaps" (Saiwai Shobo), "Printing Ink Technologies" (CMC Publishing Co., Ltd., 1984) and "State-of-the-Art Pigment Application Technologies" (CMC Publishing Co., Ltd., 1986).

The particle diameter of the pigment is preferably in the range of 0.01 to 10 μm, more preferably of 0.05 to 1 μm, and particularly preferably of 0.1 to 1 μm, from the points of dispersibility in the photosensitive layer-coating solution and homogeneity of the photosensitive layer.

For dispersing a pigment, any one of the dispersion methods known in the art and used for production of inks, toners, and the like may be used. Suitable dispersing machines include ultrasonic dispersing machine, sand mill, attriter, pearl mill, super mill, ball mill, impeller, disperser, KD mill, colloid mill, dynatron, three roll mill, pressurized kneader, and the like. More detailed description on such dispersing machines is found in the "State-of-the-Art Pigment Application Technologies" (CMC Publishing Co., Ltd., 1986).

When used in the photosensitive layer according to the invention, the infrared absorbent may be added to the same layer in combination with other components or to another separate layer; but, from the viewpoint of sensitivity, the optical density of the photosensitive layer at the absorption maximum at a wavelength in the range of 760 to 1,200 nm is preferably 0.1 to 3.0 when a negative-type planographic printing plate precursor is prepared. The optical density of the layer is determined by the addition amount of the infrared absorbent and the thickness of the photosensitive layer, and a particular optical density is obtained by adjusting these conditions properly. The optical density of photosensitive layer is determined by an ordinary method. Examples of the measurement methods include a method of forming a photosensitive layer having a post-drying thickness properly selected in the range suitable for planographic printing plate on a transparent or white support and measuring the optical density thereof with a transmission optical densitometer, a method of forming the photosensitive layer on a reflexible support such as aluminum and measuring the reflection density thereof, and the like.

The amount of the infrared absorbent (C) added to the photosensitive layer is preferably in the range of 0.01 to 40% by mass, more preferably, in the range of 0.1 to 20% by mass, and still more preferably in the range of 1 to 15% by mass.

[Sensitizer (C') Having an Absorption Maximum of 300 to 600 nm]

For image formation by irradiation of a laser in the visible region of 350 to 450 nm, the photosensitive layer according to the invention preferably contains a sensitizer having an absorption maximum of 300 to 600 nm (C') (hereinafter, sometimes referred to as "sensitizer"). Examples of such sensitizers include spectroscopic dyes and the dyes and pigments shown below that interact with a photopolymerization initiator by absorption of the light from a light source.

Preferable examples of the spectroscopic dyes and dyes include polycyclic aromatic compounds (such as pyrene, perylene, and triphenylene), xanthenes (such as fluorescein, eosin, erythrosine, rhodamine B, and rose bengal), cyanines (such as thiacarbocyanine and oxacarbocyanine), merocyanines (such as merocyanine and carbomerocyanine), thiazines (such as thioene, methylene blue, and toluidine blue), acridines (such as acridine orange, chloroflavine, and acriflavine), phthalocyanines (such as phthalocyanine and metal phthalocyanines), porphyrins (such as tetraphenyl porphyrin, and central metal-substituted porphyrins), chlorophylls (such as chlorophyll, chlorophyllin, and central metal-substituted chlorophylls), metal complexes, anthraquinones (such as anthraquinone), squariums (such as squarium), and the like.

Examples of more preferable spectroscopic dyes and dyes include the styryl-based dyes described in JP-B No. 37-13034; the cation dyes described in JP-A No. 62-143044; the quinoxalinium salts described in JP-B No. 59-24147; the new methylene blue compound described in JP-A No. 64-33104; the anthraquinones described in JP-A No. 64-56767; the benzoxanthene dyes described in JP-A No. 2-1714; the acridines described in JP-A Nos. 2-226148 and 2-226149; the pyrylium salts described in JP-B No. 40-28499; the cyanines described in JP-B No. 46-42363; the benzofuran dyes described in JP-A No. 2-63053; the conjugate ketone dyes described in JP-A Nos. 2-85858 and 2-216154; the dyes described in JP-A No. 57-10605; the azo cinnamylidene derivatives described in JP-B No. 2-30321; the cyanine-based dyes described in JP-A No. 1-287105; the xanthene-based dyes described in JP-A Nos. 62-31844, 62-31848, and 62-143043; the aminostyrylketone described in JP-B No. 59-28325; the merocyanine dyes described in JP-B No. 61-9621; the dyes described in JP-A No. 2-179643; the merocyanine dyes described in JP-A No. 2-244050; the merocyanine dyes described in JP-B No. 59-28326; the merocyanine colorants described in JP-A No. 59-89803; the merocyanine dyes described in JP-A No. 8-129257; the benzopyran-based dyes described in JP-A No. 8-334897; and the like.

The sensitizer for use in the invention is more preferably a compound represented by the following Formula (c).

Formula (c)

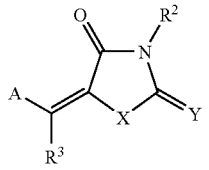

In Formula (c), A represents an aromatic or hetero ring that may be substituted; X represents an oxygen or sulfur atom or —N($R^1$)—; and Y represents an oxygen or sulfur atom or —N($R^1$)—. $R^1$, $R^2$, $R^3$ each independently represent a hydrogen atom or a non-metal atom group; and A and $R^1$, $R^2$, or $R^3$ may bind to each other, forming an aliphatic or aromatic ring.

When $R^1$, $R^2$, or $R^3$ in Formula (c) is a monovalent non-metal atom group, it preferably represents a substituted or unsubstituted alkyl or aryl group.

Hereinafter, preferable examples of the groups $R^1$, $R^2$, and $R^3$ in Formula (c) will be described specifically. Preferable examples of the alkyl groups include straight-chain, branched, and cyclic alkyl groups having 1 to 20 carbon atoms; and specific examples thereon include methyl, ethyl, propyl, butyl, pentyl, hexyl, heptyl, octyl, nonyl, decyl, undecyl, dodecyl, tridecyl, hexadecyl, octadecyl, eicosyl, isopropyl, isobutyl, s-butyl, t-butyl, isopentyl, neopentyl, 1-methylbutyl, isohexyl, 2-ethylhexyl, 2-methylhexyl, cyclohexyl, cyclopentyl, and 2-norbornyl groups. Among them, straight-chain alkyl groups having 1 to 12 carbon atoms, branched alkyl groups having 3 to 12 carbon atoms, and cyclic alkyl groups having 5 to 10 carbon atoms are more preferable.

The substituent group of the substituted alkyl group is a monovalent non-metal atom group other than hydrogen, and preferable examples thereof include halogen atoms (—F, —Br, —Cl, and —I), a hydroxyl group, alkoxy groups, aryloxy groups, a mercapto group, alkylthio groups, arylthio groups, alkyldithio groups, aryldithio groups, an amino group, N-alkylamino groups, N,N-dialkylamino groups, N-arylamino groups, N,N-diarylamino groups, N-alkyl-N-arylamino groups, acyloxy groups, carbamoyloxy groups, N-alkylcarbamoyloxy groups, N-arylcarbamoyloxy groups, N,N-dialkylcarbamoyloxy groups, N,N-diarylcarbamoyloxy groups, N-alkyl-N-arylcarbamoyloxy groups, alkylsulfoxy groups, arylsulfoxy groups, acyloxy groups, acylthio groups, acylamino groups, N-alkylacylamino groups, N-arylacylamino groups, a ureido group, N'-alkylureido groups, N',N'-dialkylureido groups, N'-arylureido groups, N',N'-diarylureido groups, N'-alkyl-N'-arylureido groups, N-alkylureido groups, N-arylureido groups, N'-alkyl-N-alkylureido groups, N'-alkyl-N-arylureido groups, N',N'-dialkyl-N-alkylureido groups, N',N'-dialkyl-N-arylureido groups, N'-aryl-N-alkylureido groups, N''-aryl-N-arylureido groups, N',N'-diaryl-N-alkylureido groups, N',N'-diaryl-N-arylureido groups, N'-alkyl-N'-aryl-N-alkylureido groups, N'-alkyl-N'-aryl-N-arylureido groups, alkoxycarbonylamino groups, aryloxycarbonylamino groups, N-alkyl-N-alkoxycarbonylamino groups, N-alkyl-N-aryloxycarbonylamino groups, N-aryl-N-alkoxycarbonylamino groups, N-aryl-N-aryloxycarbonylamino groups, a formyl group, acyl groups, a carboxyl group, alkoxycarbonyl groups, aryloxycarbonyl groups, carbamoyl groups, N-alkylcarbamoyl groups, N,N-dialkylcarbamoyl groups, N-arylcarbamoyl groups, N,N-diarylcarbamoyl groups, N-alkyl-N-arylcarbamoyl groups, alkylsulfinyl groups, arylsulfinyl groups, alkylsulfonyl groups, arylsulfonyl groups, a sulfo group (—$SO_3H$) and the conjugate base groups (hereinafter, referred to as sulfonato groups), alkoxysulfonyl groups, aryloxysulfonyl groups, sulfinamoyl groups, N-alkylsulfinamoyl groups, N,N-dialkylsulfinamoyl groups, N-arylsulfinamoyl groups, N,N-diarylsulfinamoyl groups, N-alkyl-N-arylsulfinamoyl groups, a sulfamoyl group, N-alkylsulfamoyl groups, N,N-dialkylsulfamoyl groups, N-arylsulfamoyl groups, N,N-diarylsulfamoyl groups, N-alkyl-N-arylsulfamoyl groups, a phosphono group (—$PO_3H_2$) and the conjugate base groups thereof (hereinafter, referred to as phosphonato groups), dialkyl phosphono groups (—$PO_3(alkyl)_2$), diarylphosphono groups (—$PO_3(aryl)_2$), alkylarylphosphono groups (—$PO_3(alkyl)(aryl)$), monoalkylphosphono groups (—$PO_3H(alkyl)$) and the conjugate base groups thereof (hereinafter, referred to as alkylphosphonato groups), monoaryl phosphono groups (—$PO_3H(aryl)$) and the conjugate base groups thereof (hereinafter, referred to as arylphosphonato groups), a phosphonoxy group (—$OPO_3H_2$) and the conjugate base groups thereof (hereinafter, referred to as phosphonatoxy groups), dialkylphosphonoxy groups (—$OPO_3(alkyl)_2$), diarylphosphonoxy groups (—$OPO_3(aryl)_2$), alkylarylphosphonoxy groups (—$OPO_3(alkyl)(aryl)$), monoalkylphosphonoxy groups (—$OPO_3H(alkyl)$) and the conjugate base groups thereof (hereinafter, referred to as alkylphosphonatoxy groups), monoarylphosphonoxy groups (—$OPO_3H(aryl)$) and the conjugate base groups thereof (hereinafter, referred to as arylphosphonatoxy groups), a cyano group, a nitro group, aryl groups, heteroaryl groups, alkenyl groups, alkynyl groups, and silyl groups.

Specific examples of the alkyl groups in these substituent groups include the alkyl groups described above, and these groups may be substituted additionally.

Specific examples of the aryl groups include phenyl, biphenyl, naphthyl, toluoyl, xylyl, mesityl, cumenyl, chlorophenyl, bromophenyl, chloromethylphenyl, hydroxyphenyl, methoxyphenyl, ethoxyphenyl, phenoxyphenyl, acetoxyphenyl, benzyoloxyphenyl, methylthiophenyl, phenylthiophenyl, methylaminophenyl, dimethylaminophenyl, acetylaminophenyl, carboxyphenyl, methoxycarbonylphenyl, ethoxyphenylcarbonyl, phenoxycarbonylphenyl, N-phenylcarbamoylphenyl, cyanophenyl, sulfophenyl, sulfonatophenyl, phosphonophenyl, and phosphonatophenyl groups, and the like.

The heteroaryl group is a group derived from a monocyclic or polycyclic aromatic ring containing at least one nitrogen, oxygen, sulfur atom, and examples of the heteroaryl rings in the particularly preferable heteroaryl group include thiophene, thiathrene, furan, pyran, isobenzofuran, chromane, xanthene, phenoxazine, pyrrole, pyrazole isothiazole, isoxazole, pyrazine, pyrimidine, pyridazine, indolizine, isoindolizine, indoyl, indazole, purine, quinolizine, isoquinoline, phthalazine, naphthyridine, quinazoline, cinnoline, pteridine, carbazole, carboline, phenanthrene, acridine, perimidine, phenanthroline, phthalazine, phenarsazine, phenoxazine, furazan, and the like, and these compounds may be fused with a benzene ring and also substituted.

Examples of the alkenyl groups include vinyl, 1-propenyl, 1-butenyl, cinnamyl, 2-chloro-1-ethenyl and other groups, and examples of the alkynyl groups include ethynyl, 1-propynyl, 1-butynyl, trimethylsilylethynyl and other groups. Examples of $G^1$ in the acyl group ($G^1CO$—) include hydrogen and the alkyl and aryl groups described above. More preferably among the substituent groups are halogen atoms (—F, —Br, —Cl, and —I), alkoxy groups, aryloxy groups, alkylthio groups, arylthio groups, N-alkylamino groups, N,N-dialkylamino groups, acyloxy groups, N-alkylcarbamoyloxy groups, N-arylcarbamoyloxy groups, acylamino groups, a formyl group, acyl groups, a carboxyl group, alkoxycarbonyl groups, aryloxycarbonyl groups, carbamoyl groups, N-alkylcarbamoyl groups, N,N-dialkylcarbamoyl groups, N-arylcarbamoyl groups, N-alkyl-N-arylcarbamoyl groups, a sulfo group, sulfonato groups, sulfamoyl groups, N-alkylsulfamoyl groups, N,N-dialkylsulfamoyl groups, N-arylsulfamoyl groups, N-alkyl-N-arylsulfamoyl groups, a phosphono group, a phosphonato group, dialkylphosphono groups, diarylphosphono groups, monoalkylphosphono groups, alkyl phosphonato groups, monoarylphosphono groups, aryl phosphonato groups, phosphonooxy groups, phosphonatoxy groups, aryl groups, alkenyl groups, and alkylidene groups (methylene group, etc.).

On the other hand, examples of the alkylene group in the substituted alkyl group include divalent organic residue from the alkyl groups having 1 to 20 carbon atoms described above from which any of the hydrogen atoms is eliminated, and preferable are straight-chain alkyl groups having 1 to 12 carbon atoms, branched alkyl groups having 3 to 12 carbon atoms, and cyclic alkylene group having 5 to 10 carbon atoms.

Specific examples of the substituted alkyl group preferable as $R^1$, $R^2$, or $R^3$ obtained in combination of the substituent group and an alkylene group include chloromethyl, bromomethyl, 2-chloroethyl, trifluoromethyl, methoxymethyl, methoxyethoxyethyl, allyloxymethyl, phenoxymethyl, methylthiomethyl, toluoylthiomethyl, ethylaminoethyl, diethylaminopropyl, morpholinopropyl, acetyloxymethyl, benzoyloxymethyl, N-cyclohexylcarbamoyloxyethyl, N-pheylcarbamoyloxyethyl, acetylaminoethyl, N-methylbenzoylaminopropyl, 2-oxoethyl, 2-oxopropyl, carboxypropyl, methoxycarbonylethyl, allyloxycarbonylbutyl, chlorophenoxycarbonylmethyl, carbamoylmethyl, N-methylcarbamoylethyl, N,N-dipropylcarbamoylmethyl, N-(methoxyphenyl)carbamoylethyl, N-methyl-N-(sulfophenyl)carbamoylmethyl, sulfobutyl, sulfonatopropyl, sulfonatobutyl, sulfamoylbutyl, N-ethylsulfamoylmethyl, N,N-dipropylsulfamoylpropyl, N-toluylsulfamoylpropyl, N-methyl-N-(phosphonophenyl)sulfamoyloctyl, phosphonobutyl, phosphonatohexyl, diethylphosphonobutyl, diphenylphosphonopropyl, methylphosphonobutyl, methylphosphonatobutyl, toluylphosphonohexyl group, toluylphosphonatohexyl, phosphonooxypropyl, phosphonatoxybutyl, benzyl, phenethyl, α-methylbenzyl, 1-methyl-1-phenylethyl, p-methylbenzyl, cinnamyl, allyl, 1-propenylmethyl, 2-butenyl, 2-methyl allyl, 2-methylpropenylmethyl, 2-propynyl, 2-butynyl, 3-butynyl and other groups.

Specific examples of the aryl groups preferable as $R^1$, $R^2$, or $R^3$ in Formula (C) include fused rings of one to three benzene rings and fused rings of a benzene ring and a five-membered unsaturated ring; specific examples thereof include phenyl, naphthyl, anthryl, phenanthryl, indenyl, acenaphthenyl, and fluorenyl groups, and more preferable among them are phenyl and naphthyl groups.

Specific examples of the substituted aryl groups preferable as $R^1$, $R^2$, or $R^3$ include aryl groups described above having a substituent group, a monovalent non-metal atom group, on the ring-forming carbon atom (other than hydrogen atom). Examples of the preferable substituent groups include alkyl and substituted alkyl groups and the groups described above favorable above as the substituent groups for the substituted alkyl group. Typical preferable examples of the substituted aryl groups include biphenyl, toluoyl, xylyl, mesityl, cumenyl, chlorophenyl, bromophenyl, fluorophenyl, chloromethylphenyl, trifluoromethylphenyl, hydroxyphenyl, methoxyphenyl, methoxyethoxyphenyl, allyloxyphenyl, phenoxyphenyl, methylthiophenyl, toluylthiophenyl, ethylaminophenyl, diethylaminophenyl, morpholino phenyl, acetyloxyphenyl, benzoyloxyphenyl, N-cyclohexylcarbamoyloxyphenyl, N-pheylcarbamoyloxyphenyl, acetylaminophenyl, N-methylbenzoylaminophenyl, carboxyphenyl, methoxycarbonylphenyl, allyloxycarbonylphenyl, chlorophenoxycarbonylphenyl, carbamoylphenyl, N-methylcarbamoylphenyl, N,N-dipropylcarbamoylphenyl, N-(methoxyphenyl)carbamoylphenyl, N-methyl-N-(sulfophenyl) carbamoylphenyl, sulfophenyl, sulfonatophenyl, sulfamoylphenyl, N-ethylsulfamoylphenyl, N,N-dipropylsulfamoylphenyl, N-toluylsulfamoylphenyl, N-methyl-N-(phosphonophenyl)sulfamoylphenyl, phosphonophenyl, phosphonatophenyl, diethylphosphonophenyl, diphenylphosphonophenyl, methylphosphonophenyl, methyl phosphonatophenyl, toluylphosphonophenyl, toluylphosphonatophenyl, allylphenyl, 1-propenylmethylphenyl, 2-butenylphenyl, 2-methyl allylphenyl, 2-methylpropenylphenyl, 2-propynylphenyl, 2-butynylphenyl, 3-butynylphenyl, and other groups.

More preferable examples of $R^2$ and $R^3$ in Formula (c) include substituted or unsubstituted alkyl groups. More preferable examples of $R^1$ include substituted or unsubstituted aryl groups. Although the mechanism is not yet understood, it seems that presence of such a substituent leads to increase in interaction between the electronically excited state generated by photoabsorption and the initiator compound and also to improvement in efficiency of generating the radical, acid or base of the initiator compound.

Hereinafter, A in Formula (c) will be described. A represents an aromatic or hetero ring that may be substituted; and specific examples thereof include those exemplified above for $R^1$, $R^2$, or $R^3$ in Formula (c).

Among these, preferable examples of A include alkoxy, thioalkyl, and amino group-containing aryl groups, and particularly preferable examples of A are amino group-containing aryl groups.

Hereinafter, Y in Formula (c) will be described. Y represents a non-metal atom group needed for forming a heterocyclic ring, together with A above and the neighboring carbon atoms. Such heterocyclic rings include five-, six- and seven-membered nitrogen- or sulfur-containing heterocyclic rings that may have one or more fused ring, preferably five- and six-membered heterocyclic rings.

Preferable examples of the nitrogen-containing heterocyclic rings include those known as the basic skeleton for merocyanine colorants described in L. G. Brooker et al., Journal of American Chemical Society (J. Am. Chem. Soc.) 73 (1951), pp. 5326-5358, and the reference literatures therein.

Specific examples thereof include thiazoles (such as thiazole, 4-methylthiazole, 4-phenylthiazole, 5-methylthiazole, 5-phenylthiazole, 4,5-dimethylthiazole, 4,5-diphenylthiazole, 4,5-di(p-methoxyphenylthiazole), 4-(2-thienyl)thiazole, and 4,5-di(2-furyl)thiazole), benzothiazoles (such as benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 4-phenylbenzothiazole, 5-phenylbenzothiazole, 4-methoxybenzothiazole, 5-methoxybenzothiazole, 6-methoxybenzothiazole, 5-iodobenzothiazole, 6-iodobenzothiazole, 4-ethoxybenzothiazole, 5-ethoxybenzothiazole, tetrahydrobenzothiazole, 5,6-dimethoxybenzothiazole, 5,6-dioxymethylene benzothiazole, 5-hydroxybenzothiazole, 6-hydroxybenzothiazole, 6-dimethylaminobenzothiazole, and 5-ethoxycarbonylbenzothiazole), naphthothiazoles (such as naphtho[1,2]thiazole, naphtho[2,1]thiazole, 5-methoxynaphtho[2,1]thiazole, 5-ethoxynaphtho[2,1]thiazole, 8-methoxynaphtho[1,2]thiazole, and 7-ethoxynaphtho[1,2]thiazole), thianaphtheno-7',6',4,5-thiazoles (such as 4'-methoxythianaphtheno-7',6',4,5-thiazole), oxazoles (such as 4-methyloxazole, 5-methyloxazole, 4-phenyloxazole, 4,5-diphenyloxazole, 4-ethyloxazole, 4,5-dimethyloxazole, and 5-phenyloxazole), benzoxazoles (benzoxazole, 5-chlorobenzoxazole, 5-methylbenzoxazole, 5-phenylbenzoxazole, 6-methyl benzoxazole, 5,6-dimethylbenzoxazole, 4,6-dimethylbenzoxazole, 6-methoxybenzoxazole, 5-methoxybenzoxazole, 4-ethoxybenzoxazole, 5-chlorobenzoxazole, 6-methoxybenzoxazole, 5-hydroxybenzoxazole, and 6-hydroxybenzoxazole), naphthoxazoles (such as naphtho[1,2]oxazole and naphtho[2,1] oxazole), selenazoles (such as 4-methylselenazole and 4-phenylselenazole), benzoselenazoles (such as benzoselenazole, 5-chlorobenzoselenazole, 5-methoxybenzoselenazole, 5-hydroxybenzoselenazole, and tetrahydrobenzoselenazole), naphthoselenazoles (such as naphtho[1,2]selenazole and naphtho[2,1]selenazole), thiazolines (such as thiazoline, 4-methylthiazoline, 4,5-dimethylthiazoline, 4-phenylthiazoline, 4,5-di(2-furyl)thiazoline, 4,5-diphenylthiazoline, and 4,5-di(p-methoxyphenyl)thiazoline), 2-quinolines (such as quinoline, 3-methylquinoline, 5-methylquinoline, 7-methylquinoline, 8-methylquinoline, 6-chloroquinoline, 8-chloroquinoline, 6-methoxyquinoline, 6-ethoxyquinoline, 6-hydroxyquinoline, and 8-hydroxyquinoline), 4-quinolines (such as quinoline, 6-methoxyquinoline, 7-methylquinoline, and 8-methylquinoline), 1-isoquinolines (such as isoquinoline and 3,4-dihydroisoquinoline), 3-isoquinolines (such as isoquinoline), benzimidazoles (such as 1,3-dimethylbenzimidazole, 1,3-diethylbenzimidazole, and 1-ethyl-3-phenylbenzimidazole), 3,3-dialkylindolenines (such as 3,3-dimethylindolenine, 3,3,5-trimethylindolenine, and 3,3,7-trimethylindolenine), 2-pyridines (such as pyridine and 5-methylpyridine), and 4-pyridines (such as pyridine). In addition, the substituent groups on these rings may bind to each other, forming a ring.

Examples of the sulfur-containing heterocyclic rings include the dithiol partial structures in the colorants described in JP-A No. 3-296759.

Specific examples thereof include benzodithiols (such as benzodithiol, 5-t-butylbenzodithiol, and 5-methylbenzodithiol), naphthodithiols (such as naphtho[1,2]dithiol and naphtho[2,1]dithiol), and dithiols (such as 4,5-dimethyldithiols, 4-phenyldithiols, 4-methoxycarbonyldithiols, 4,5-dimethoxycarbonyldithiols, 4,5-diethoxycarbonyldithiols, 4,5-ditrifluoromethyldithiol, 4,5-dicyanodithiol, 4-methoxycarbonylmethyldithiol, and 4-carboxymethyldithiol).

Among the nitrogen- or sulfur-containing heterocyclic rings formed by Y, A and the neighboring carbon atoms in Formula (C) described above, the colorants having a structure represented by the partial structural Formula of the following Formula (d) are particularly preferable, because they give a photosensitive composition higher in sensitization potential and considerably superior in storage stability.

Formula (d)

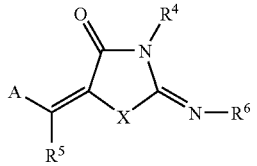

In Formula (d), A represents an aromatic or hetero ring that may be substituted; and X represents an oxygen or sulfur atom or —N($R^1$). $R^1$, $R^4$, $R^5$, $R^6$ each independently represent a hydrogen atom or a monovalent non-metal atom group; and A and $R^1$, $R^4$, $R^5$, or $R^6$ may bind to each other, forming an aliphatic or aromatic ring.

In Formula (d), A and $R^1$ are the same as those in Formula (C); $R^4$, $R^2$ in Formula (c); $R^5$, $R^3$ in Formula (C); and $R^6$, $R^1$ in Formula (C).

The compound represented by Formula (c) is more preferably a compound represented by the following Formula (e).

Formula (e)

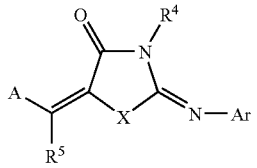

In Formula (e), A represents an aromatic or hetero ring that may be substituted; and X represents an oxygen or sulfur atom or —N($R^1$)—. $R^1$, $R^4$, and $R^5$ each independently represent a hydrogen atom or a monovalent non-metal atom group; and A and $R^1$, $R^4$, or $R^5$ may bind to each other, forming an aliphatic or aromatic ring. Ar represents a substituted aromatic or hetero ring. However, the total Hammett value of the substituents on the Ar skeleton is preferably more than 0. The total Hammett value of more than 0 means that the ring has one substituent group and the substituent group has a Hammett value of more than 0, or that the ring has multiple substituent groups and the total Hammett value of these substituent groups is more than 0.

In Formula (e), A and $R^1$ are the same as those in Formula (c); $R^4$, $R^2$ in Formula (c); and $R^5$, $R^3$ in Formula (c). Ar represents a substituted aromatic or hetero ring, and specific examples of thereof include those for the substituted aromatic ring or heteroring described for A in Formula (C). However, the substituent group that may be introduced on Ar in Formula (e) should have a total Hammett value of 0 or more, and examples of such substituent groups include halogen atoms, trifluoromethyl, carbonyl, ester, nitro, cyano, sulfoxide, amide, and carboxyl groups, and the like. The Hammett values of these substituent groups are shown below: trifluoromethyl group (—$CF_3$, m: 0.43, p: 0.54), carbonyl group (e.g., —COH, m: 0.36, p: 0.43), ester group (—$COOCH_3$, m: 0.37, p: 0.45), halogen atom (e.g., Cl, m: 0.37, p: 0.23), cyano group (—CN, m: 0.56, p: 0.66), sulfoxide group (e.g., —$SOCH_3$, m: 0.52, p: 0.45), amido group (e.g., —NH-$COCH_3$, m: 0.21, p: 0.00), carboxyl group (—COOH, m: 0.37, p: 0.45), and the like. Each parenthesis above includes the site of the substituent group introduced on the aryl skeleton and its Hammett value, and, for example, (m: 0.50) means that the substituent group introduced at the meta position has a Hammett value of 0.50. Preferable examples of Ar among them include substituted phenyl groups, and preferable substituents on the Ar skeleton include ester and cyano groups. The substituent is particularly preferably introduced at the ortho site on the Ar skeleton.

Hereinafter, preferable specific examples of the sensitizers represented by Formula (c) (exemplification compounds D1 to D59) will be shown, however the invention is not limited thereto. Among them, compounds corresponding to those represented by Formula (d) are exemplification compounds D2, D6, D10, D18, D21, D28, D31, D33, D35, D38, D41, and D45 to D57.

(D1)

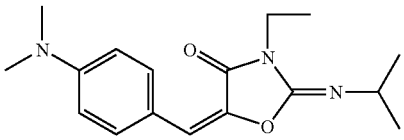

(D2)

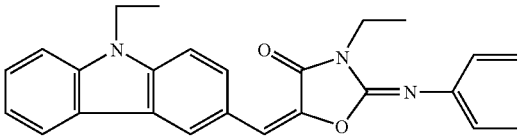

(D3)

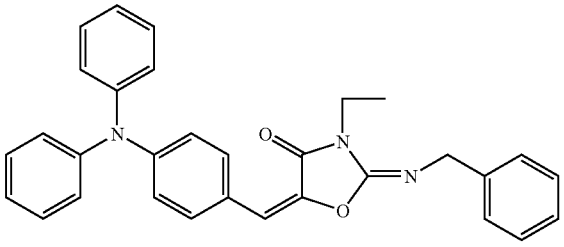

(D4)

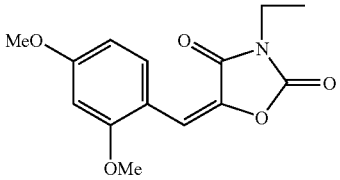

-continued (D5)

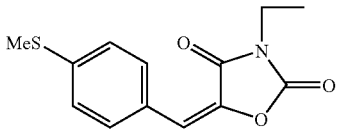

(D6)

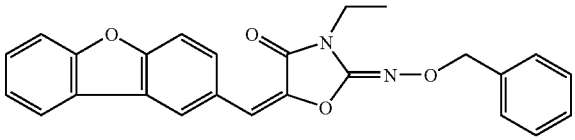

(D7)

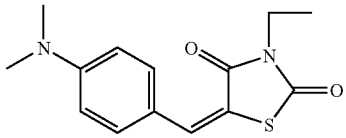

(D8)

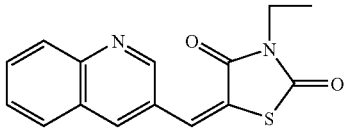

(D9)

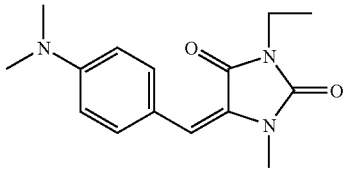

(D10)

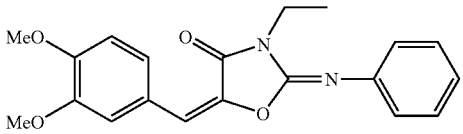

(D11)

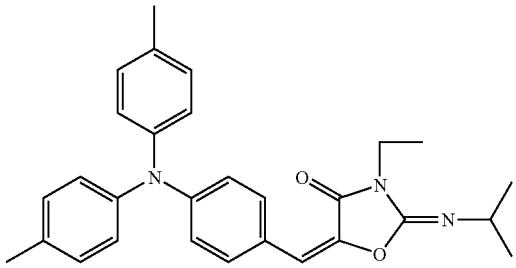

(D12)

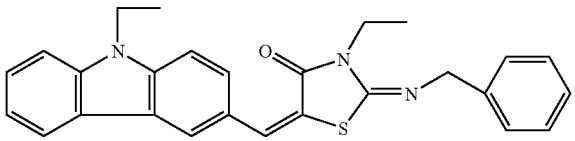

(D13)

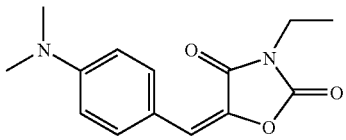

-continued
(D14)
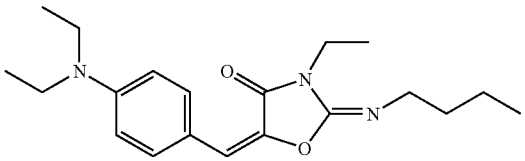
(D15)
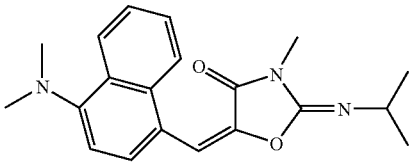
(D16)
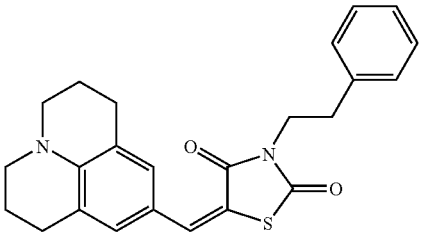
(D17)
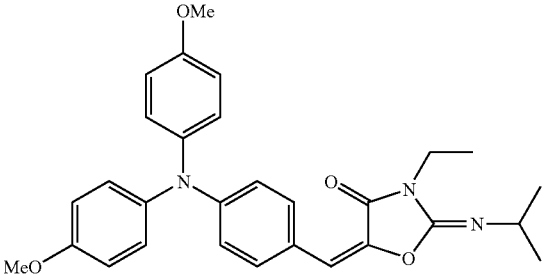
(D18)
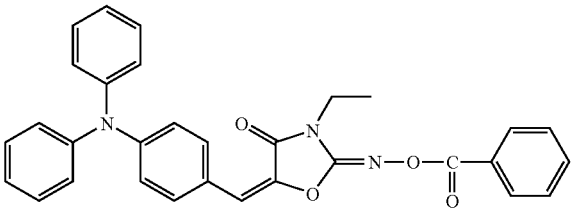
(D19)
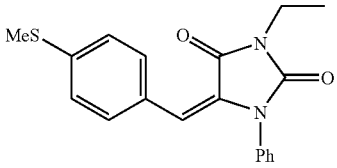
(D20)
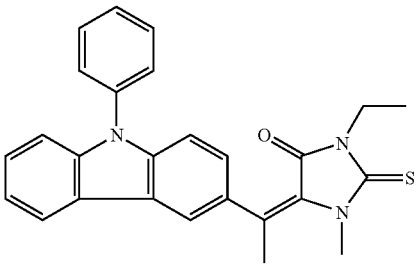
-continued
(D21)
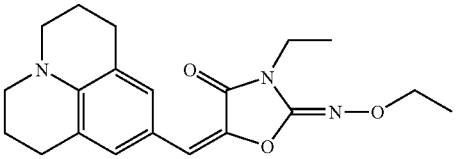
(D22)
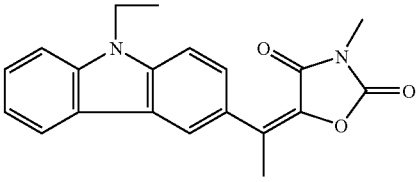
(D23)
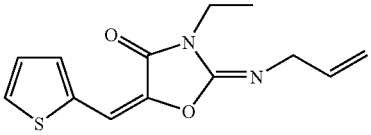
(D24)
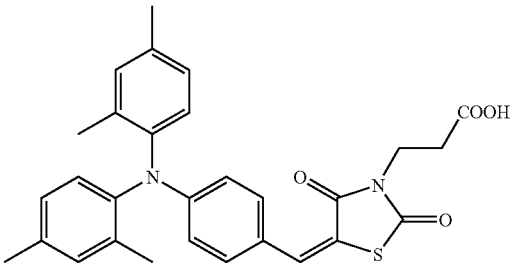
(D25)
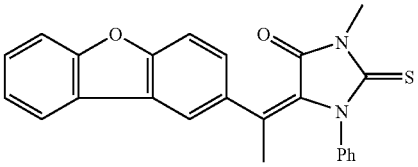
(D26)
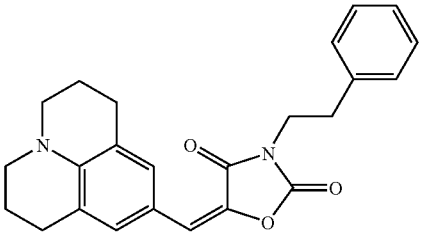
(D27)
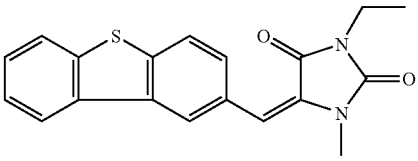

-continued
(D28)
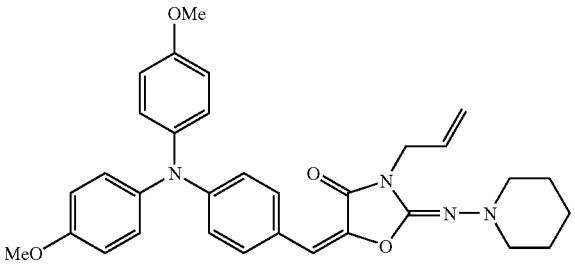
(D29)
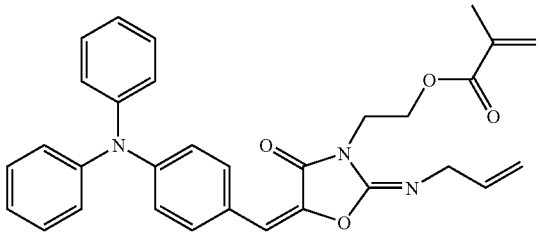
(D30)
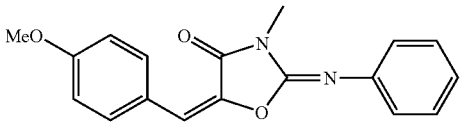
(D31)
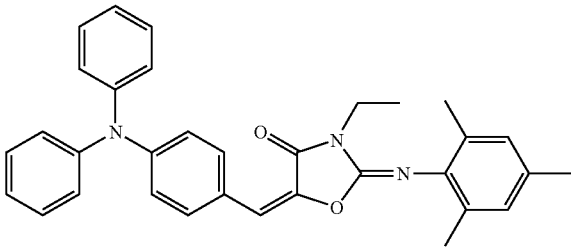
(D32)
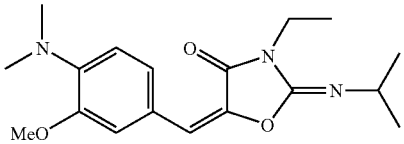
(D33)
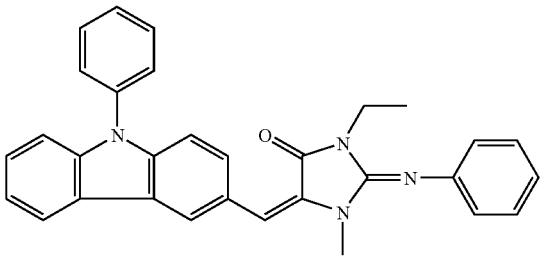
(D34)
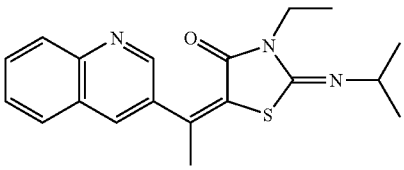
-continued
(D35)
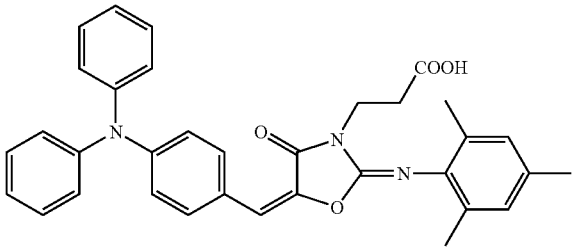
(D36)
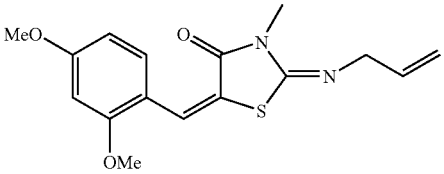
(D37)
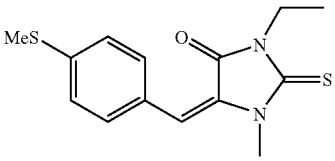
(D38)
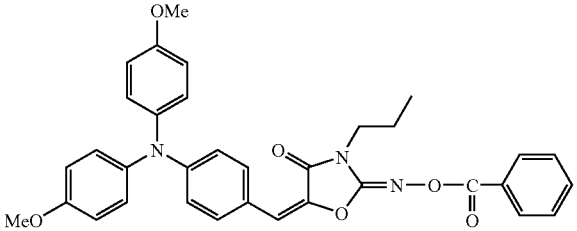
(D39)
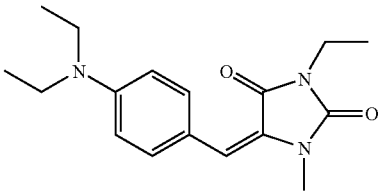
(D40)
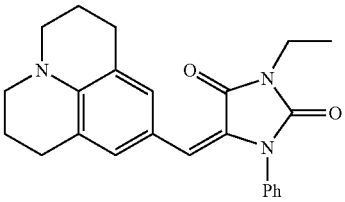
(D41)
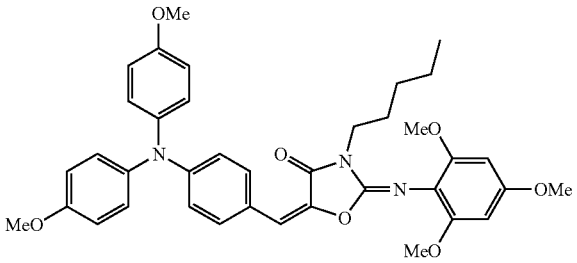

-continued
(D42)
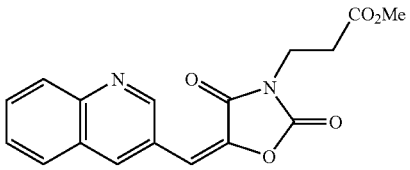
(D43)
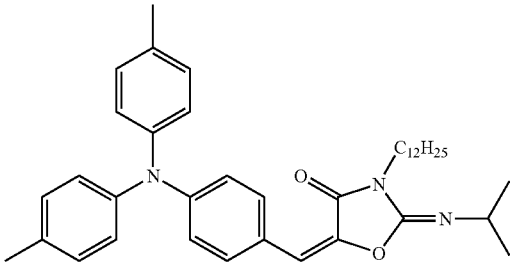
(D44)
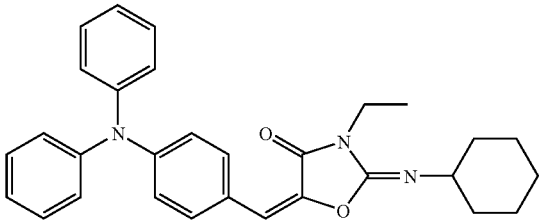
(D45)
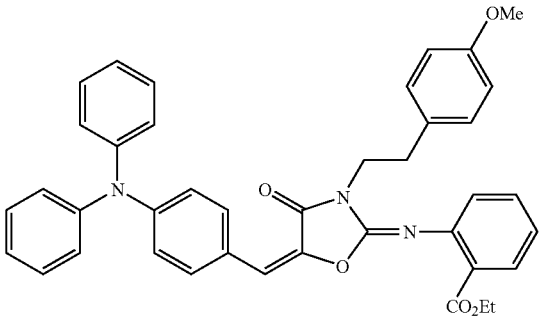
(D46)
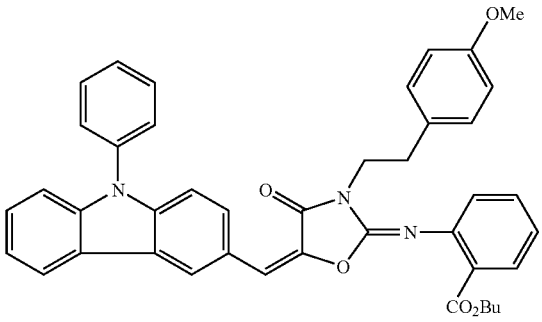
-continued
(D47)
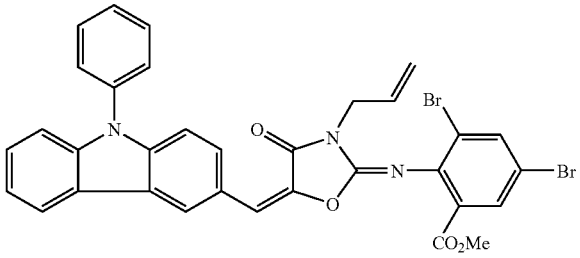
(D48)
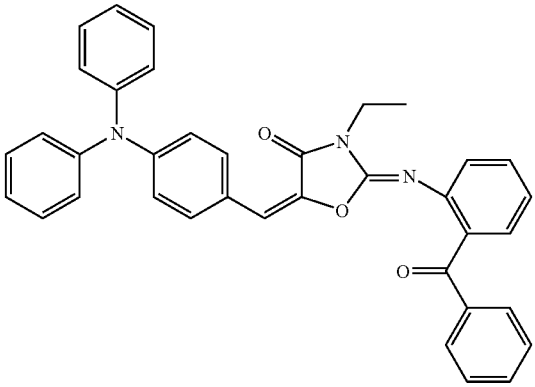
(D49)
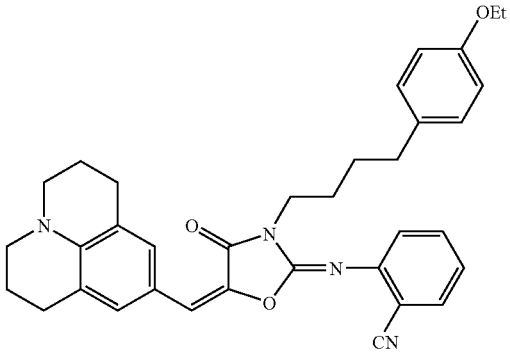
(D50)
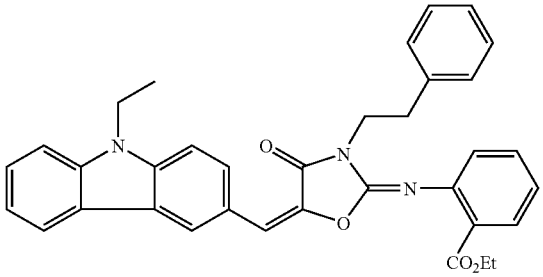
(D51)
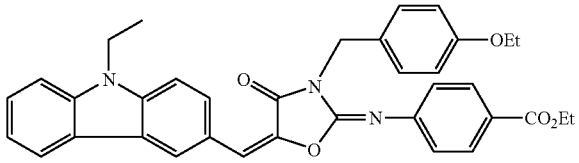

-continued (D52)

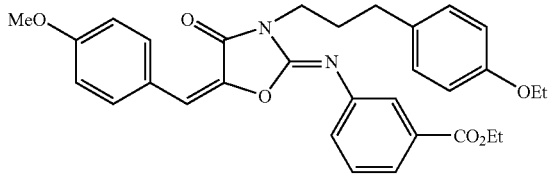

(D53)

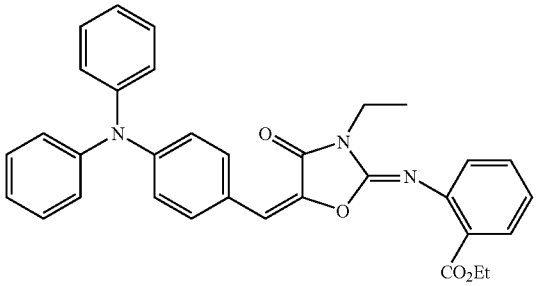

(D54)

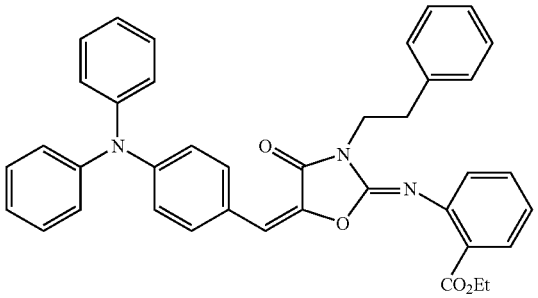

(D55)

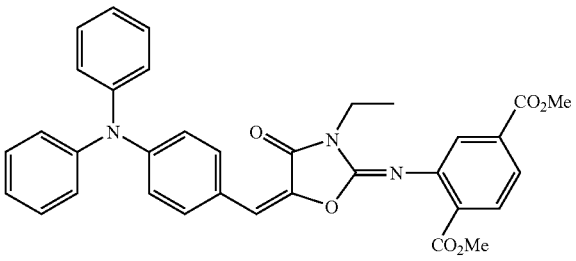

(D56)

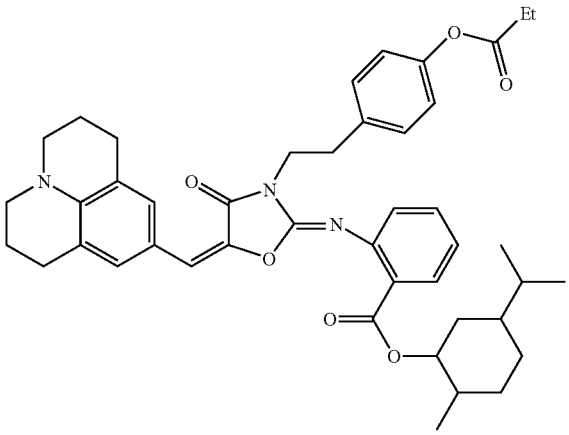

-continued (D57)

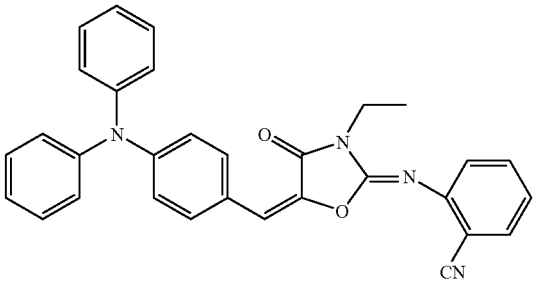

(D58)

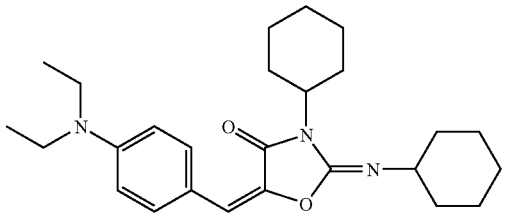

(D59)

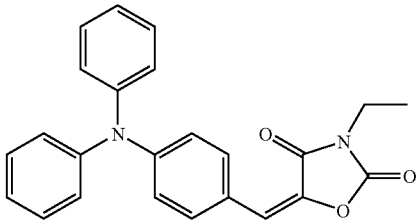

The sensitizer for use in the invention may be modified chemically in various ways, for further improvement in properties of the photosensitive layer. For example, it is possible to increase the strength of the exposed film and prevent undesirable precipitation of the colorant in the photoexposed film, for example, by allowing the sensitizer to bind to an addition polymerizable compound structure (such as acryloyl or methacryloyl group) by covalent, ionic, or hydrogen bonding.

It is also possible to increase the photosensitivity drastically when the concentration of the initiator system is low, by allowing the sensitizer to bind with the polymerization-initiator partial structure capable of generating radicals described above (a reductive cleavage site such as alkyl halide, onium or peroxide, biimidazole, or an oxidative cleavage site such as borate, amine, trimethylsilylmethyl, carboxymethyl, carbonyl, or imine).

It is also effective to introduce a hydrophilic site (an acidic or polar group such as a carboxyl group or the ester thereof, a sulfonic acid group or the ester thereof, or an ethyleneoxide group), for improvement in the compatibility of the planographic printing plate precursor to an alkali- or water-based developing solution. In particular, ester-based hydrophilic groups are superior in compatibility, because they are present in a relatively hydrophobic structure in the photosensitive layer and generate an acid group by hydrolysis in the developing solution increasing their hydrophilicity.

Other suitable substituent groups may also be introduced, for example, for improvement in compatibility in the photosensitive layer and prevention of crystal precipitation. For example, introduction of an unsaturated bond such as aryl or allyl may be considerably effective in improving compatibility in some photosensitization systems, while introduction of a branched alkyl structure, i.e., increase in the steric hindrance between colorant π planes, prevents crystal precipitation significantly. Alternatively, introduction of a phosphonic acid, epoxy, trialkoxysilyl, or other group improves the adhesiveness to inorganic materials such as metals and metal oxides. Other methods, for example polymerization of sensitizer, may be used according to application.

The sensitizer (C') for use in the invention is preferably at least one of the sensitizers represented by Formula (c), and details of the method of using the sensitizer represented by Formula (c), for example structure of the sensitizer (modification), single or combined use of two or more, and addition amount, are suitably decided according to the preferable characteristics of the final photosensitive material. For example, combined use of two or more kinds of sensitizers leads to improvement in compatibility to the photosensitive layer.

Both the photosensitivity and the molar extinction coefficient at the emission wavelength of the light source used are the important factors in selecting the sensitizer. Use of a sensitizer having a higher molar extinction coefficient is economical, because it leads to reduction in the amount thereof added, and also advantageous from the point of physical properties of the photosensitive layer. In the invention, other commonly used sensitizers may be used in addition to the sensitizer represented by Formula (c) in a range that does not impair the advantageous effects of the invention.

The photosensitivity and definition of the photosensitive layer and the physical properties of the exposed film are directly influenced by the absorbance at the light source wavelength, and the addition amount of the sensitizer is determined carefully, considering such an influence. For example, in the region of an absorbance of 0.1 or less the layer is less sensitive. It is also lower in definition, because of halation. However, such a low absorbance may allow an increase in the degree of hardening, for example, for hardening a thick film having a thickness of 5 μm or more. In the regions having an absorbance of 3 or more, most light is absorbed on the photosensitive layer surface resulting in inhibition of hardening inside and giving a photosensitive layer surface insufficient in film strength and adhesiveness to the support.

For example, in preparation of a relatively thin photosensitive layer, the sensitizer is preferably added in such an amount that the absorbance of the photosensitive layer becomes in the range of 0.1 to 1.5, preferably in the range of 0.25 to 1. Since the absorbance is determined only by the addition amount of the sensitizer and the thickness of the photosensitive layer, it is possible to obtain a particular absorbance by adjusting these conditions. The absorbance of photosensitive layer can be determined by an ordinary method. Examples of the measuring methods include a method of forming a photosensitive layer, having an appropriately determined thickness for the range of the coating amount after drying preferable for the planographic printing plate, on a transparent or white support and measuring the absorbance thereof with a transmission optical densitometer, a method of forming a photosensitive layer on a reflective support such as of aluminum and determining the reflection density, and the like.

The amount of the sensitizer (C') added is normally in the range of 0.05 to 30 parts by mass, preferably 0.1 to 20 parts by mass, more preferably 0.2 to 10 parts by mass with respect to 100 parts by mass of the total solid content in the photosensitive layer.

((D) Binder Polymer)

The photosensitive layer according to the invention preferably contains a binder polymer (D), in addition to the components above, for improvement in film properties. The binder preferably contains a linear organic polymer.

Any one of "linear organic polymers" may be used. Preferable are linear organic polymers soluble or swelling in water or weakly alkaline water that allow development in water or weakly alkaline water. The linear organic polymer is used not only as a film-forming agent for forming the photosensitive layer, but also as a water, weakly-alkaline-water or organic-solvent developer, as it is properly selected according to applications selection. For example, use of a water-soluble organic polymer allows development in water. Examples of the linear organic polymers include radical polymers having carboxylic acid groups on the side chains such as those described in JP-A No. 59-44615, JP-B Nos. 54-34327, 58-12577, 54-25957, and JP-A Nos. 54-92723, 59-53836, and 59-71048, more specifically such as methacrylic acid copolymers, acrylic acid copolymers, itaconic acid copolymers, crotonic acid copolymers, maleic acid copolymers, partially esterified maleic acid copolymers, and the like. Also preferable are acidic cellulose derivatives having carboxylic acid groups on the side chains. Other useful polymers include cyclic anhydride adducts of a hydroxyl group-containing polymer.

Among them, (meth)acrylic resins having (meth)acryloyl, benzyl or allyl groups and carboxyl groups on the side chains are particularly preferable, because they are superior in the balance of film strength, sensitivity, and printing efficiency.

The following "water-insoluble and alkaline water-soluble polymers" (hereinafter, simply referred to as "alkaline water-soluble polymers") may be used as the binder polymer. It is possible to form a layer only with the alkaline water-soluble polymer, because it is a water-insoluble and alkaline water-soluble polymer that is superior in film-forming efficiency. The alkaline water-soluble polymers according to the invention include homopolymers having acidic groups on the main chains and/or the side chains of the polymer and the copolymers or mixtures thereof. Thus, the polymer layer according to the invention characteristically becomes dissolved in contact with an alkaline developing solution. Among these, the polymers having an acidic group (1) to (6) on the main chain and/or the side chain are particularly preferable, from the point of solubility in the alkaline developing solution.

(1) Phenolic hydroxyl group (—Ar—OH)

(2) Sulfonamido group (—$SO_2$NH—R)

(3) Substituted sulfonamide-based acidic groups (hereinafter, referred to as "active imide groups")

[—$SO_2$NHCOR, —$SO_2$NH$SO_2$R, and —CONH$SO_2$R]

(4) Carboxylic acid group (—$CO_2$H)

(5) Sulfonic acid group (—$SO_3$H)

(6) Phosphoric acid group (—$OPO_3H_2$)

In Formulae (1) to (6), Ar represents a divalent aryl connecting group that may be substituted; and R represents a hydrogen atom or a hydrocarbon group that may be substituted.

((E) Cosensitizer)

It is possible to improve the sensitivity of the photosensitive layer further by adding a cosensitizer to the photosensitive layer. Although the action mechanism is not clear yet, it seems that the phenomenon is mostly based on the following chemical processes. Specifically, the cosensitizer seems to react with various intermediate active species (radical, peroxide, oxidizing agent, reducing agent, etc.) generated in the photoreaction of the photopolymerization initiator (system) by photoabsorption and subsequent addition polymerization reaction, generating additional active radicals. These cosensitizers can be grouped roughly into (a) those generating active radicals by reduction, (b) those generating active radicals by oxidation, and (c) those generating a high-activity radical in reaction with a low-activity radical or functioning as a chain-transfer agent, and there are still many compounds, the group of which is not clear yet.

(a) Compounds Generating an Active Radical by Reduction

Compounds having a carbon-halogen bond: generating an active radical by reductive cleavage of a carbon-halogen bond. Preferable specific examples thereof include trihalomethyl-s-triazines, trihalomethyloxadiazoles, and the like.

Compounds having a nitrogen-nitrogen bond: generating an active radical by oxidative cleavage of a nitrogen-nitrogen bond. Preferable specific examples thereof include hexaarylbiimidazoles and the like.

Compounds having an oxygen-oxygen: generating an active radical by reductive cleavage of an oxygen-oxygen bond. Preferable specific examples thereof include organic peroxides and the like.

Onium compounds: generating an active radical by reductive cleavage of a carbon-hetero atom bond or an oxygen-nitrogen bond. Preferable specific examples thereof include diaryliodonium salts, triarylsulfonium salts, N-alkoxypyridinium (azinium) salts, and the like.

Ferrocene and iron arene complexes: generating an active radical reductively.

(b) Compounds Generating an Active Radical by Oxidation

Alkyl ate complexes: generating an active radical by oxidative cleavage of a carbon-hetero atom bond. Preferable specific examples thereof include triarylalkylborates.

Alkylamine compounds: generating an active radical by oxidative cleavage of a C—X bond on the carbon close to the nitrogen. X is favorably a hydrogen atom, a carboxyl, trimethylsilyl, or benzyl group, or the like. Specific examples thereof include ethanolamines, N-phenylglycines, N-trimethylsilylmethylanilines, and the like.

Sulfur- and tin-containing compounds: the amines described above with its nitrogen atom replaced with a sulfur atom or tin atom, which generate an active radical similarly. In addition, S—S bond-containing compounds are also known to cause amplification by S—S cleavage.

α-substituted methylcarbonyl compounds: generating an active radical by oxidative cleavage of a carbonyl-α carbon bond. The compounds above with its carbonyl group replaced with an oxime ether group also have a similar action. Specific examples thereof include 2-alkyl-1-[4-(alkylthio)phenyl]-2-morpholinopronone-1, and the oxime ethers thereof prepared by reaction with hydroxy amines and subsequent etherification of N—OH.

Sulfinic acid salts: generating an active radical reductively. Specific examples thereof include sodium arylsulfinates and the like.

(c) Compounds Generating a High-Activity Radical in Reaction with a Low-Activity Radical or Functioning as a Chain-Transfer Agent Examples thereof favorably used include compounds having SH, PH, SiH, or GeH in the molecule. These compounds generate a radical by donating hydrogen to the less active radical species or by deprotonation after oxidation. Specific examples thereof include 2-mercaptobenzimidazoles and the like.

More specific examples of these cosensitizers are described as additives for improvement in sensitivity in JP-A No. 9-236913. Hereinafter, some of them are shown below, however the cosensitizers preferable for the photosensitive layer in the planographic printing plate precursor according to the invention are not limited thereto.

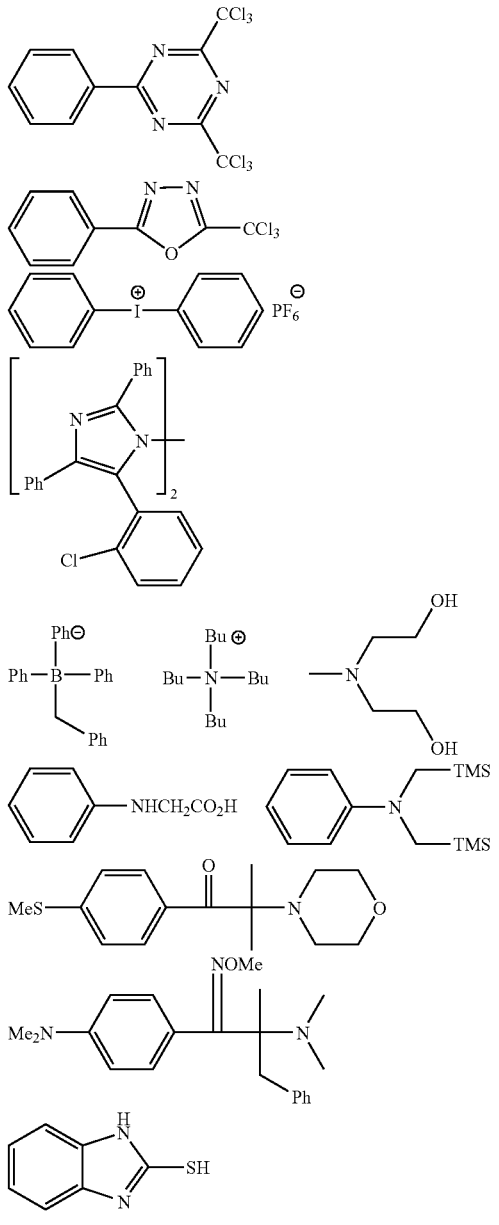

The cosensitizer may also be modified chemically in various ways, additionally for improvement in the properties of the photosensitive layer. Examples of the modifications include binding of a sensitizer, titanocene, addition-polymerizable unsaturated compound, or the like to the radical-generating unit, introduction of a hydrophilic unit, introduction of a substituent group for improvement in compatibility or prevention of crystal precipitation, introduction of a substituent group for improvement in adhesiveness, polymerization, and others.

These cosensitizers may be used alone or in combination of two or more. The addition amount is in the range of 0.05 to 100 parts by mass, preferably 1 to 80 parts by mass, and more preferably 3 to 50 parts by mass, with respect to 100 parts by mass of the addition-polymerizable compound.

((F) Colorant)

The photosensitive layer according to the invention may contain various compounds as needed, in addition to the components above. For example, a dye absorbing light strongly in the visible light region may be used as an image colorant. Specific examples thereof include Oil Yellow #101, Oil Yellow #103, Oil Pink #312, Oil Green BG, Oil Blue BOS, Oil Blue #603, Oil Black BY, Oil Black BS, and Oil Black T-505 (manufactured by Orient Chemical Industries, Ltd.), Victoria Pure Blue, crystal violet (CI42555), methyl violet (CI42535), ethyl violet, rhodamine B (CI145170B), malachite green (CI42000), methylene blue (CI52015), and the dyes described in JP-A No. 62-293247. In addition, phthalocyanine-based pigments, azo-based pigments, carbon black, and pigments such as titanium oxide are also used favorably.

The colorant is preferably added for distinct differentiation between image and non-image regions after image formation. The addition amount is 0.01 to 10% by mass with respect to the total solid content in the image recording material.

((G) Heat-polymerization Inhibitor)

In the invention, a trace amount of a heat-polymerization inhibitor is preferably added for prevention of undesirable thermal polymerization of the radical-polymerizable compound during production or storage of the planographic printing plate precursor. Preferable examples of the heat-polymerization inhibitors include hydroquinone, p-methoxyphenol, di-t-butyl-p-cresol, pyrogallol, t-butylcatechol, benzoquinone, 4,4'-thiobis(3-methyl-6-t-butylphenol), 2,2'-methylene-bis(4-methyl-6-t-butylphenol), and N-nitroso-N-phenyl hydroxylamine aluminum salt.

The amount of the heat-polymerization inhibitor to be added is preferable, approximately 0.01 to 5% by mass with respect to the total solid content in the image recording layer.

A higher fatty acid derivative such as behenic acid or behenic amide may be added as needed to the image recording layer and distributed on the surface of the image recording layer in the drying process after application, for prevention of polymerization inhibition by oxygen. The amount of the higher fatty acid derivative added is preferably, approximately 0.1 to 10% by mass with respect to the total solid content in the image recording layer.

((H) Surfactant)

A nonionic surfactant such as that described in JP-A No. 62-251740 or 3-208514 or an amphoteric surfactant such as that described in JP-A No. 59-121044 or 4-13149 may be added to the planographic printing plate precursor according to the invention, for improvement in stability during development of the photosensitive layer.

Specific examples of the nonionic surfactants include sorbitan tristearate, sorbitan monopalmitate, sorbitan trioleate, monoglyceride stearate, polyoxyethylene nonylphenylether and the like.

Specific examples of the amphoteric surfactant include alkyldi(aminoethyl)glycines, alkylpolyaminoethylglycine hydrochloride salts, 2-alkyl-N-carboxyethyl-N-hydroxyethylimidazolinium betaines, N-tetradecyl-N,N-betaines (for example, trade name: Amorgen K, manufactured by Daiichi Kogyo Co., Ltd.), and the like. The content ratio of the nonionic surfactant or the amphoteric surfactant in the photosensitive layer-coating solution is preferably 0.05 to 15% by mass, more preferably 0.1 to 5% by mass.

In addition, a plasticizer may be added to the photosensitive layer-coating solution according to the invention as needed, for example for providing the coated layer with flexibility. Examples thereof include polyethylene glycol, tributyl citrate, diethyl phthalate, dibutyl phthalate, dihexyl phthalate, dioctyl phthalate, tricresyl phosphate, tributyl phosphate, trioctyl phosphate, tetrahydrofurfuryl oleate, and the like.

[Formation of Photosensitive Layer]

The photosensitive layer is normally formed by dissolving the components needed for the photosensitive layer-coating solution in a solvent and coating the mixture on a suitable support. Examples of the solvents for use include, but are not limited to, ethylene dichloride, cyclohexanone, methylethylketone, methanol, ethanol, propanol, ethylene glycol monomethylether, 1-methoxy-2-propanol, 2-methoxyethyl acetate, 1-methoxy-2-propyl acetate, dimethoxyethane, methyl lactate, ethyl lactate, N,N-dimethylacetamide, N,N-dimethylformamide, tetramethylurea, N-methylpyrrolidone, dimethylsulfoxide, sulfolane, γ-butylolactone, toluene, water and the like. These solvents may be used alone or in combination. The concentration of the components (total solids including additives) is preferably 1 to 50% by mass.

The coating amount (solid content) of the photosensitive layer obtained on the support after coating and drying may vary according to applications, but is preferably, generally 0.5 to 5.0 g/m$^2$. Various methods may be used for coating. Various coating methods including, for example, bar coater coating, spin coating, spray coating, curtain coating, dip coating, air knife coating, blade coating, roll coating, and the like, may be used for coating.

Decrease in coating amount leads to apparent increase in sensitivity, but actually to deterioration in the film properties of the photosensitive layer.

A surfactant, for example, a Fluorochemical surfactant described in JP-A No. 62-170950, may be added to the photosensitive layer-coating solution, for improvement in coating efficiency. The preferable addition amount is 0.01 to 1% by mass, more preferably 0.05 to 0.5% by mass, with respect to the total solids in the photosensitive layer-coating solution.

<Undercoat Layer>

An intermediate layer (undercoat layer) may be formed between the photosensitive layer and the support on the planographic printing plate precursor according to the invention, for improving the adhesiveness and smut resistance of the plate. Specific examples of the intermediate layer include those described in JP-B No. 50-7481; JP-A Nos. 54-72104, 59-101651, 60-149491, 60-232998, 3-56177, 4-282637, 5-16558, 5-246171, 7-159983, 7-314937, 8-202025, 8-320551, 9-34104, 9-236911, 9-269593, 10-69092, 10-115931, 10-161317, 10-260536, 10-282682, 11-84674, 10-69092, 10-115931, 11-38635, 11-38629, 10-282645, 10-301262, 11-24277, 11-109641, 10-319600, 11-84674, 11-327152, 2000-10292, 2000-235254, 2000-352854, 2001-209170, and others; JP-A No. 2001-175001, and others.

[Support]

The support for use in the invention is not particularly limited, if it is a dimensionally rigid plate, and examples thereof include paper, papers laminated with a plastic material (for example, polyethylene, polypropylene, polystyrene, or the like), metal plates (for example, aluminum, zinc, copper, etc.), plastic films (for example, cellulose diacetate, cellulose triacetate, cellulose propionate, cellulose butyrate, cellulose acetate butyrate, cellulose nitrate, polyethylene terephthalate, polyethylene, polystyrene, polypropylene, polycarbonate, polyvinylacetal, etc.), and the like. The support may be a single-component sheet such as resin sheet or metal plate or a laminate of two or more materials, and examples thereof include papers and plastic films having such a metal film laminated or vapor-deposited thereon, laminated sheets of different plastic films, and the like.

The support is particularly preferably a hydrophilized aluminum support.

Preferable aluminum supports are pure aluminum plates and alloy plates containing aluminum as the main component and trace amounts of foreign elements, or may be plastic films laminated or deposited with aluminum. The foreign elements in the aluminum alloys include silicon, iron, manganese, copper, magnesium, chromium, zinc, bismuth, nickel, and titanium. The content of the foreign elements in the alloy is preferably 10% by mass or less. Aluminum particularly preferable in the invention is pure aluminum, however the aluminum plate may contain a trace amount of foreign elements, because it is difficult to prepare completely pure aluminum due to the problems in the refining process. Thus, the composition of the aluminum plate used in the invention is not particularly limited, and any aluminum plate of a material known in the art may be used favorably.

The thickness of the aluminum plate for use in the invention is approximately 0.1 mm to 0.6 mm, preferably approximately 0.15 mm to 0.4 mm, and particularly preferably 0.2 mm to 0.3 mm.

If desired, the surface of the aluminum plate is subjected, before surface roughening, to degreasing treatment for removing the rolling oils on the surface thereof, with a surfactant, organic solvent, aqueous alkaline solution, or the like.

Various methods may be used for surface roughening of the aluminum plate, and examples thereof include methods of scratching mechanically, dissolving the surface electrochemically, and dissolving selectively the surface chemically. The mechanical methods include methods known in the art such as ball milling, brush milling, blast milling, and buff milling. The electrochemical surface roughening may be conducted, for example, in an electrolyte containing hydrochloric acid or nitric acid by applying alternate or direct current. Alternatively, the combined mechanical and electrochemical method described in JP-A No. 54-63902 may also be used.

The aluminum plate surface-roughened in this manner may be etched in an alkaline solution and neutralized and then subjected to an anodizing treatment if desired for improvement in water holding property and abrasion resistance of the surface. Any one of various electrolytes that can form porous oxide layer may be used as the electrolyte for use in the anodizing treatment of the aluminum plates, and such an electrolyte is generally sulfuric acid, phosphoric acid, oxalic acid, chromic acid, or the mixture thereof. The concentration of the electrolyte is favorably decided according to the kind of the electrolyte.

The conditions for the anodic oxidation vary according to the electrolytes used and are not particularly specified, but are generally suitable if the concentration of the electrolytes is 1 to 80% by mass; the liquid temperature, 5 to 70° C.; the electric current density, 5 to 60 A/dm$^2$; the voltage, 1 to 100 V; and the electrolysis period, 10 seconds to 5 minutes.

The amount of the anodic oxide film formed is preferably in the range of 1.0 g/m$^2$ or more, more preferably 2.0 to 6.0 g/m$^2$. The anodized layer formed in an amount of less than 1.0 g/m$^2$ often results in insufficient printing durability, makes the non-image region of planographic printing plate more susceptible to damages, and consequently, causes the problems of "scratch staining", i.e., adhesion of ink to the damaged region during printing.

Although the anodizing processing is performed on the printing surface of planographic printing plate support, an anodized layer of 0.01 to 3 g/m$^2$ in thickness is generally formed on the rear surface for prevention of the adverse effects by the electric lines of force reaching there.

Any one of the conventionally known methods may be used for hydrophilization of support surfaces after the anodizing processing. An example of the hydrophilizing treatment used in the invention is the treatment with an alkali metal silicate (e.g., aqueous sodium silicate solution) disclosed in U.S. Pat. Nos. 2,714,066, 3,181,461, 3,230,734 and 3,902,734. By this method, the support is subjected to immersion treatment or electrolyzing treatment in an aqueous sodium silicate solution or electrolyzed. Alternatively, the support may be subjected to the methods of treating it with potassium fluorozirconate disclosed in JP-B No. 36-22063 and of treating it with polyvinylphosphonic acid disclosed in U.S. Pat. Nos. 3,276,868, 4,153,461, and 4,589,272.

Among these methods, particularly preferable in the invention is the silicate salt treatment. The silicate salt treatment will be described below.

The aluminum plate carrying the anodized oxide layer formed as described above is immersed in an aqueous solution containing an alkali metal silicate salt at a concentration of 0.1 to 30% by mass, preferably 0.5 to 10% by mass and having a pH of 10 to 13 at 25° C., for example, at 15 to 80° C. for 0.5 to 120 seconds. A pH of the aqueous alkali metal silicate salt solution of less than 10 leads to gelation of the solution, while a pH of higher than 13.0 to dissolution of the oxide film. Examples of the alkali metal silicate salts for use in the invention include sodium silicate, potassium silicate, lithium silicate, and the like. Hydroxides used for raising the pH of the aqueous alkali metal silicate salt solution include sodium hydroxide, potassium hydroxide, hydroxide lithium, and the like. An alkali earth metal salt or a Group-IVB metal salt may be added to the processing solution above. Examples of the alkali earth metal salts include water-soluble salts including nitrate salts such as calcium nitrate, strontium nitrate, manganese nitrate, barium nitrate, sulfate salts, hydrochloride salts, phosphate salts, acetate salts, oxalate salts, borate salts, and the like. Examples of the Group-IVB metal salts include titanium tetrachloride, titanium trichloride, titanium potassium fluoride, titanium potassium oxalate, titanium sulfate, titanium tetraiodide, zirconium chloride oxide, zirconium dioxide, zirconium oxychloride, zirconium tetrachloride, and the like. The alkali earth metal salts or the Group-IVB metal salts may be used alone or in combination of two or more. The content of these metal salts is in the range of preferably 0.01 to 10% by mass and more preferably 0.05 to 5.0% by mass.

The silicate salt treatment improves the hydrophilicity of the aluminum plate surface further, prohibiting ink to adhere onto the non-image portion and improving the smut resistance of the plate.

[Backcoat Layer]

A backcoat layer is formed as needed on the rear surface of the support. A metal oxide film prepared by hydrolysis and polycondensation of the organic polymer compound described in JP-A No. 5-45885 or the organic or inorganic metal compounds described in JP-A No. 6-35174 is favorably used as the backcoat layer.

Among these films, metal oxide films prepared from silicon alkoxides are particularly preferable, because the silicon alkoxide compounds such as $Si(OCH_3)_4$, $Si(OC_2H_5)_4$, $Si(OC_3H_7)_4$, and $Si(OC_4H_9)_4$ can be obtained cheaply and the films are superior in development durability.

The planographic printing plate precursor according to the invention is prepared in the manner described above. Images can be recorded on the planographic printing plate precursor by using a laser such as visible or infrared laser. It is also possible to record images by using a ultraviolet lamp or a thermal head. The irradiation light source in the invention is selected properly according to the kind of the photosensitive layer, however image irradiation with a visible light laser having a wavelength of 350 to 450 nm or a infrared light-emitting solid-state or a semiconductor laser having a wavelength of 760 to 1,200 nm is preferable.

After exposure to infrared laser, the planographic printing plate precursor is preferably developed with water or an aqueous alkaline solution.

If an aqueous alkaline solution is used as the developing solution, any one of conventionally known aqueous alkaline solutions may be used as developing and replenishing solutions for the polymerizable composition according to the invention. Examples of the alkali compounds include inorganic alkali salts such as sodium silicate, potassium silicate, trisodium phosphate, tripotassium phosphate, triammonium phosphate, disodium phosphate, dipotassium phosphate, diammonium phosphate, sodium carbonate, potassium carbonate, ammonium carbonate, sodium bicarbonate, potassium bicarbonate, ammonium bicarbonate, sodium borate, potassium borate, ammonium borate, sodium hydroxide, ammonium hydroxide, potassium hydroxide, and lithium hydroxide, organic bases such as monomethylamine, dimethylamine, trimethylamine, monoethylamine, diethylamine, triethylamine, monoisopropylamine, diisopropylamine, triisopropylamine, n-butylamine, monoethanolamine, diethanolamine, triethanolamine, monoisopropanolamine, diisopropanolamine, ethyleneimine, ethylenediamine, pyridine; and the like.

These alkali agents may be used alone or in combination of two or more.

In addition, it is known that it is possible to develop a greater number of planographic printing plate precursors in automatic developing machine without exchanging the developing solution in developing tank for an extended period of time, by adding the same developing solution or an aqueous solution (replenishing solution) higher in alkali strength than the developing solution thereto. The replenishing method is preferable applied also to the invention.

Various surfactants and organic solvents may be added if needed to the developing and replenishing solutions for the purpose of accelerating or suppressing the printing efficiency, dispersing the development scums, and improving the hydrophilicity of the image portions of the printing plate. Preferable surfactants include anionic, cationic, nonionic and amphoteric surfactants. Preferable organic solvents include benzyl alcohol and the like. Addition of polyethylene glycol or the derivative thereof, or poly propylene glycol or the derivative thereof, or the like is also preferable. Further, a nonreducing sugar such as arabit, sorbit, or mannitol may be added.

In addition, hydroquinone, resorcin, a reducing agent such as sodium or potassium salt of an inorganic acid such as sodium or potassium sulfite and bisulfite, an organic carboxylic acid, an antifoam agent, a water softener may be added if needed to the developing and replenishing solutions.

The printing plate processed using the developing and replenishing solutions is then post-treated with washing water, a rinsing solution containing surfactants and the like, a desensitizing solution containing gum arabic or a starch derivative. The image recording material according to the invention may be post-processed in combination of these treatments.

Recently, automatic developing machines for the printing plates have been widely used for the purpose of streamlining and standardizing the plate-making processes in the printing-plate and printing industries.

The automatic developing machines generally consist of a developing unit, a post-treatment unit, a unit for conveying printing plates, various solution stock tanks, and units for spraying the solutions, wherein the exposed printing plates are developed while they are conveyed horizontally and sprayed via spray nozzles with the solutions pumped out from the tanks. Also known is another kind of automatic developing systems, wherein the printing plates are conveyed while they are immersed in treatment solution tanks filled with treating solutions one after another by means of the submerged guide rolls or the like. In such automatic processing, the plates are processed while the solution tanks are periodically replenished with the replenishing solutions according to the number of the plates and the period of processing. The replenishing solution may be filled automatically by detecting the electric conductivity with a sensor. In addition, the method of using only essentially unused treating solutions, i.e., single-use method, may also be used in the invention.

The developed planographic printing plate thus obtained may further coated with a desensitizing gum if desired before it is sent to the printing process; or the plate is additionally subjected to a burning treatment if desired for the purpose of obtaining planographic printing plates higher in printing durability.

If the planographic printing plates are to be burned, the plates are preferably treated before the burning treatment with an surface-conditioning liquid described in JP-B Nos. 61-2518 and 55-28062 and JP-A Nos. 62-31859 and 61-159655.

The methods include application of the surface-conditioning liquid onto planographic printing plate with sponge or cotton moistened therewith, application by immersing the printing plate into a bath filled with the surface-conditioning liquid, and application by an automatic coater. Additionally, adjustment of the coating amount to uniformity by using a squeezee or a squeezee roller after application of the surface-conditioning liquid provides further preferable results.

The suitable coating amount of the surface-conditioning liquid is generally 0.03 to 0.8 g/m$^2$ (as dry weight). The planographic printing plate applied with the surface-conditioning liquid is then dried if needed and heated at high temperature in a burning processor (e.g., Burning Processor BP-1300 sold by Fuji Photo Film Co., Ltd.). The temperature and the period of the heating vary according to the kind of the components constituting the images, but are preferably in the range of 180 to 300° C. and of 1 to 20 minutes.

The planographic printing plate after the burning treatment may be then subjected if needed to treatments conventionally practiced in the art such as water washing and gumming, however if an surface-conditioning liquid containing a water-soluble polymer compound or the like is used, so-called desensitizing treatments such as gumming and the like may be eliminated.

The planographic printing plates according to the invention after these treatments are then subjected to an offset printing machine or the like, wherein they are used for printing numerous papers.

EXAMPLES

Hereinafter, the invention will be described with reference to examples, but it should be understood that the invention is not restricted thereto.

Example 1

(Preparation of Support)

An aluminum plate of JIS A1050 with a thickness of 0.30 mm and a width of 1030 mm was subjected to surface treatment as shown below.

<Surface Treatment>

In the surface treatment, the following various treatments (a) to (f) were continuously carried out. After each treatment and water washing, a nip roller was used to drain off.

(a) The aluminum plate was subjected to etching treatment carried out in the following condition: concentration of caustic soda: 26% by mass, concentration of ammonium ions: 6.5% by mass and temperature: 70° C., to dissolve 5 g/m$^2$ of the aluminum plate, followed by washing with water.

(b) The aluminum plate was subjected to desmatting treatment carried out using an aqueous 1 mass % nitric acid solution (including 0.5% by mass of aluminum ions) kept at 30° C. by spraying, followed by washing with water.

(c) The aluminum plate was subjected to electrochemical surface roughing treatment carried out continuously by using 60 Hz a.c. current. The electrolytic solution used at this time was an aqueous 1 mass % nitric acid solution (including 0.5% by mass of aluminum ions and 0.07% by mass of ammonium ions) kept at 30° C. Electrochemical surface roughening treatment was carried out by using an a.c. power source with a trapezoidal rectangular wave a.c. current having the following characteristics: the time TP required for the current to reach a peak from zero: 2 msec and duty ratio: 1:1 and also using a carbon electrode as the counter electrode. Ferrite was used as the auxiliary anode. The current density was 25 A/dm$^2$ when the current reached a peak and the quantity of electricity was 250 C/cm$^2$ as the sum of the quantity of electricity when the aluminum plate served as the anode. 5% of the current flowing from the power source was distributed to the auxiliary anode and then the aluminum plate washed with water.

(d) The aluminum plate was subjected to etching treatment carried out by spraying in the following condition: concentration of caustic soda: 26% by mass, concentration of ammonium ions: 6.5% by mass and temperature: 35° C., to dissolve 0.2 g/m$^2$ of the aluminum plate, to thereby remove the smut component which was produced when the electrochemical surface roughening treatment using a.c. current in the previous stage and primarily contained aluminum hydroxide and to dissolve the edge part of the generated pit, thereby smoothing the edge part. Then, the aluminum plate washed with water.

(e) The aluminum plate was subjected to desmatting treatment carried out using an aqueous 25 mass % sulfuric acid solution (including 0.5% by mass of aluminum ions) kept at 60° C. by spraying, followed by washing with water.

(f) The aluminum plate was subjected to anodic oxidation treatment in the following condition: concentration of sulfuric acid: 170 g/l (containing 0.5% by mass of aluminum ions), temperature: 33° C. and current density: 5 (A/dm$^2$), for 50 seconds, followed by washing with water. The weight of the anodic oxide film at this time was 2.7 g/m$^2$.

The surface roughness Ra of the aluminum support obtained in this manner was 0.27 (measuring device: SURFCOM, manufactured by TOKYO SEIMITSU Co., Ltd., diameter of the tracer head: 2 μm)

(Undercoat Layer)

Next, the following undercoat layer coating solution was applied onto the aluminum support by using a wire bar and dried at 90° C. for 30 minutes. The amount applied was 10 mg/m$^2$.

| <Undercoat layer-coating solution> | |
|---|---|
| Polymer compound A having the following structure (weight-average molecular weight: 30,000) | 0.05 g |
| Methanol | 27 g |
| Ion exchange water | 3 g |

Polymer compound A

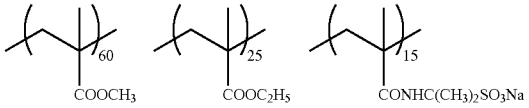

(Photosensitive Layer)

Next, the following photosensitive layer coating solution (P-1) was prepared and applied onto the undercoat layer formed on the aluminum support by using a wire bar. A drying operation was carried out at 115° C. for 34 seconds in a hot air drier to obtain a planographic printing plate precursor. The coating amount after the film was dried was 1.4 g/m$^2$.

| <Photosensitive layer-coating solution [P-1]> | |
|---|---|
| Infrared absorbent (IR-1) | 0.074 g |
| Polymerization initiator (OS-12) | 0.280 g |
| Additive (PM-1) | 0.151 g |
| Polymerizable compound (AM-1) | 1.00 g |
| Binder polymer (BT-1) (weight average molecular weight: 100,000) | 1.00 g |
| Binder polymer (BT-2) (n = average): 17, weight average molecular weight: 90,000) | 1.00 g |
| Ethyl violet (C-1) | 0.04 g |
| Fluorochemical surfactant (Megafac F-780-F, manufactured by Dainippon Ink and Chemicals, Inc., methylisobutylketone (MIBK) 30% by mass solution) | 0.015 g |
| Methylethylketone | 10.4 g |
| Methanol | 4.83 g |
| 1-Methoxy-2-propanol | 10.4 g |

The structures of the infrared absorbent (IR-1), polymerization initiator (OS-12), additive (PM-1), polymerizable compound (AM-1), binder polymer (BT-1), binder polymer (BT-2), and ethyl violet (C-1) are shown below.

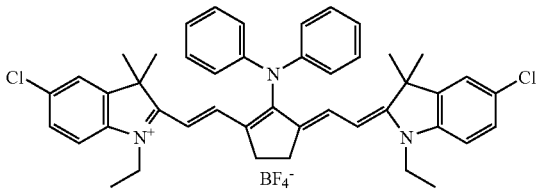

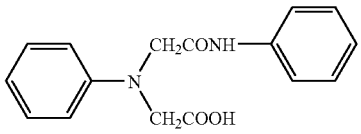

(PM-1)

-continued (AM-1)

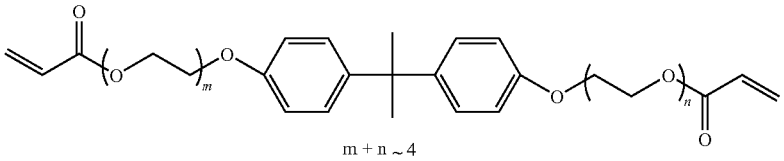

(BT-1)

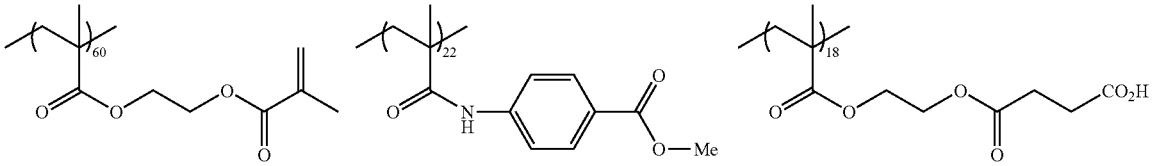

(C-1)

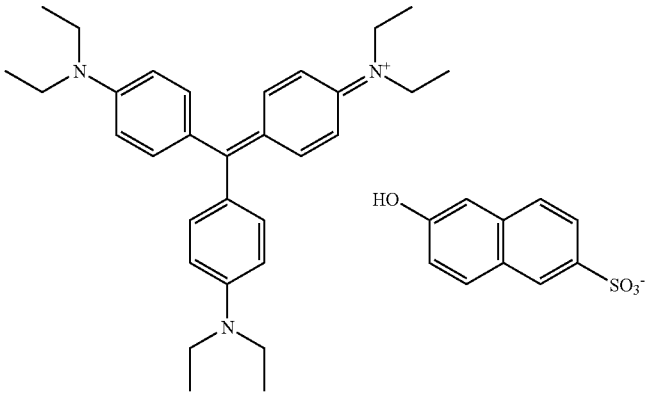

BT-2

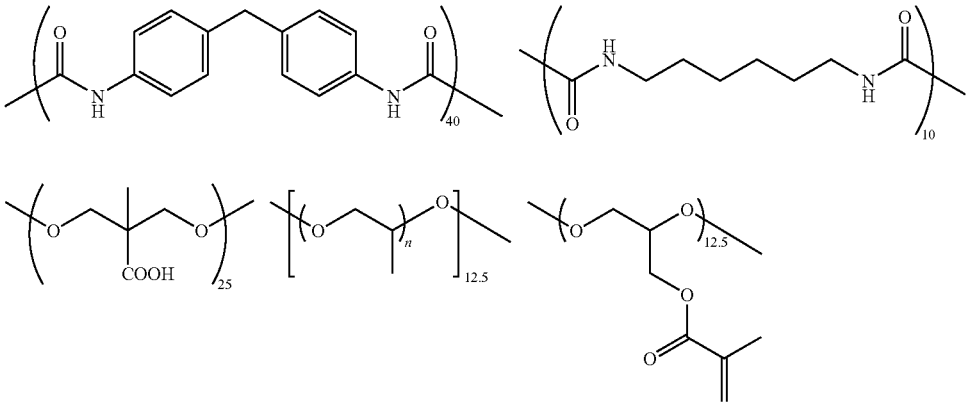

OS-12

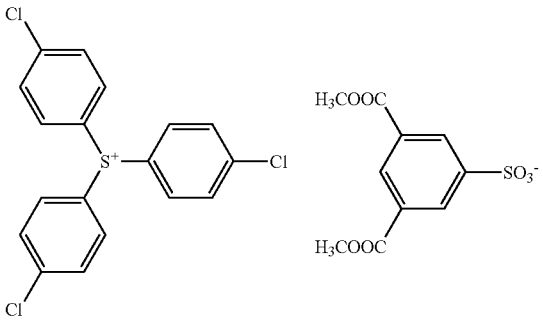

(Oxygen Barrier Layer)

A mixed aqueous solution (oxygen barrier layer coating solution) containing a synthetic mica (Somasif ME-100, 8% aqueous dispersion, manufactured by CO—OP Chemical Co. Ltd.), a specific polyvinylalcohol having a saponification degree of 91 mole % or more (GOHSERAN CKS-50, manufactured by Nippon Synthetic Chemical Industry Co., Ltd., saponification degree: 99 mol %, polymerization degree: 300, sulfonic acid-modified polyvinylalcohol), and a surfactant (Emalex 710, manufactured by Nihon-Emulsion Co., Ltd.) was coated onto the photosensitive layer with a wire bar and dried in a hot air dryer at 125° C. for 75 seconds.

The content ratio of mica solid content/polyvinylalcohol/surfactant in the mixed aqueous solution (oxygen barrier layer coating solution) was 18/80/2 (mass %), and the total coating amount (coating amount after drying) was 0.5 g/m$^2$.

—Measurement of the Oxygen Permeability of Oxygen Barrier Layer—

The oxygen permeability of an oxygen barrier layer was determined according to the following method:

The oxygen barrier layer coating solution was applied onto a photographic paper sheet, with a thickness of about 200 μm coated with 20 μm of polyethylene on both surfaces, to prepare a sample for the measurement. Since oxygen permeability of the photographic paper sheet was about 700 ml/m$^2$·day·atm under the following conditions, this value may be ignored in the measurement of oxygen permeability of the oxygen barrier layer. Oxygen permeability (ml/m$^2$·day·atm) of the oxygen barrier layer was measured at 25° C. and 60% RH using an OX-TRAN 2/20 (trade name: manufactured by Mocon Co.) according to the permeability evaluation method described in JIS K7126B and ASTM D3985.

(Protective Layer)

A mixed aqueous solution (protective layer coating solution) containing polyvinylalcohol (GOHSERAN CKS-50 manufactured by Nippon Synthetic Chemical Industry Co., Ltd., saponification degree: 99 mol %, polymerization degree: 300, sulfonic acid-modified polyvinylalcohol), a surfactant (Emalex 710, manufactured by Nihon-Emulsion Co., Ltd.), and a filler (Chemipearl W-308, manufactured by Mitsui Chemicals, Inc., high-density polyethylene particle, particle diameter: 6 μm) was coated on the oxygen barrier layer surface with a wire bar and dried in a hot air dryer at 125° C. for 75 seconds. The content ratio of filler/polyvinylalcohol/surfactant in the mixed aqueous solution (protective layer coating solution) was 2.5/93/4.5 (mass %), and the total coating amount (coating amount after drying) was 1.6 g/m$^2$.

The average particle diameter of the filler used in the protective layer and the Bekk smoothness of the planographic printing plate precursor shown in the following Table 2 were determined by the methods described above.

Examples 2 to 12

Planographic printing plate precursor of Examples 2 to 12 were prepared in a similar manner as in Example 1, except that the Chemipearl W-308 used as the filler in the mixed aqueous solution (protective layer coating solution) of Example 1 was replaced with the compound shown in Table 2 and the content ratio was changed to the composition shown in Table 2. The composition was adjusted such that when the content ratio of the filler was increased, the content of the polyvinylalcohol was decreased.

Example 13

A planographic printing plate precursor of Example 13 was prepared in a similar manner as in Example 2, except that the synthetic mica was left out from the oxygen barrier layer coating solution of Example 2.

Example 14

A planographic printing plate precursor of Example 14 was prepared in a similar manner as in Example 2, except that the polyvinylalcohol (GOHSERAN CKS-50) used in the oxygen barrier layer coating solution and the protective layer coating solution of Example 2 was replaced with a polyacrylamide (manufactured by Aldrich, molecular weight: 10,000).

Comparative Example 1

A planographic printing plate precursor of Comparative Example 1 was prepared in a similar manner as in Example 1, except that, the filler Chemipearl W-308 in the mixed aqueous solution (protective layer-coating solution) of Example 1 was left out, the content ratio of polyvinylalcohol/surfactant in the mixed aqueous solution (protective layer coating solution) was changed to 98/2 (mass %, and the total coating amount (coating amount after drying) was changed to 0.5 g/m$^2$.

Comparative Example 2

A planographic printing plate precursor of Comparative Example 2 was prepared in a similar manner as in Example 2, except that, a protective layer was formed directly on the photosensitive layer without forming the oxygen barrier layer in Example 2.

Evaluation (1) Evaluation of Sensitivity

The planographic printing plate precursor obtained was exposed to light under the condition of a resolution of 2400 dpi, a peripheral drum rotational frequency of 200 rpm, and an output changing in the range of 0 to 8 W at an interval of 0.15 as logE, by using Trendsetter Quantum 800II manufactured by Creo. The planographic printing plate precursor was exposed to light under a condition of 25° C. and 50% RH. After exposure, it was developed in an automatic developing machine LP-1310 HII manufactured by Fuji Photo Film Co., Ltd. at a conveying speed (line speed) of 2 m/minute and a developing temperature of 30° C., without water washing. The developing solution used was an aqueous 1:4 diluted solution of DH-N; the replenishing developing solution used, an aqueous 1:1.4 diluted solution of FCT-421; and the finisher, an aqueous 1:1 diluted solution of GN-2K manufactured by Fuji Photo Film Co., Ltd.

The density of the image area developed on the planographic printing plate was determined by using a Macbeth reflection densitometer RD-918, based on the cyan density obtained by using the red filter, an accessory of the densitometer. A reciprocal number of the exposure intensity needed for giving a measured density of 0.9 was determined as an indicator of the sensitivity. Evaluation results of the planographic printing plates are relative values, compared to 100 of the sensitivity of the planographic printing plate obtained in Example 1. A larger value indicates a higher sensitivity.

(2) Evaluation of Adhesiveness Between Planographic Printing Plate Precursors

Three planographic printing plate precursors obtained (10×10 cm) were conditioned in an environment at 25° C. and 75% RH for 2 hours, and the three plate precursors were stacked in the same direction without inserting interleaf sheets, to give a stack. The stack was packaged and sealed with A1 Kraft paper and left at 30° C. under a load of 4 kg for 5 days. Adhesion between the photosensitive layer side surface (protective-layer surface) of the planographic printing plate precursor and the support side rear surface of the adjacent planographic printing plate precursor of the stack was evaluated. The adhesion between planographic printing plate precursors are evaluated visually in five ranks of 1 to 5, and the rank 3 indicates the lowest level that is acceptable in practice, and the rank of 2 or less levels that are unusable in practice.

(3) Evaluation of Abrasion Resistance 30 planographic printing plate precursors obtained were stacked without inserting interleaf sheets, to give a stack. Upper 29 plate precursors in the stack were shifted by 5 cm, and a solid image over the entire surface at a definition of 2,400 dpi was formed on the bottom plate precursor in Trendsetter 3244 manufactured by Creo, at an output 7 W, an external drum rotational frequency of 150 rpm, and plate-surface energy of 110 mJ/cm$^2$. After exposure, the plate precursor was developed, similarly to the evaluation of sensitivity. Scratching in the image formed on the planographic printing plate was evaluated by visual observation. Visual evaluation results are grouped into ranks 1 to 5, and rank 3 was at the lowest level acceptable in practice, and ranks of 2 or less were unusable in practice.

(4) Evaluation of Portions where the Image was Missing

The planographic printing plate precursor was exposed at resolution of 2400 dpi, outer drum rotation speed of 200 rpm and output energy of 5 W with TRENDSETTER 800 II QUANTUM (trade name, manufactured by Creo Co.) to form a solid image. After exposure, the plate was developed with an automatic development machine (trade name: P-1320 HII, manufactured by Fuji Film Co.) at a conveying speed (line speed) of 2 m/min and at a development temperature of 30° C. without heat-treatment or washing with water. DH-N diluted with water (1:4) was used as the developing solution.

Defects where portions of the image were missing, if any, appearing at the image portion of the planographic printing plate obtained by development, were visually evaluated.

The image was evaluated in 5 ranks by visual evaluation, and rank 3 was evaluated as the lowest level acceptable in practice, while ranks 2 and 1 were evaluated to be practically unacceptable.

TABLE 2

| | Oxygen barrier layer | | Filler (in protective layer) | | | | | Evaluation | | | |
|---|---|---|---|---|---|---|---|---|---|---|---|
| | Presence of mica | Oxygen permeability | Trade Name | Kind | Average particle diameter | Content ratio | Bekk smoothness | Sensitivity | Adhesiveness | Abrasion resistance | Image defects |
| Example 1 | Yes | 5 | Chemipearl W-308 | High-density polyethylene | 6 μm | 2.5 mass % | 27 sec. | 100 | 4 | 4 | 5 |
| Example 2 | Yes | 5 | Chemipearl W-308 | High-density polyethylene | 6 μm | 5 mass % | 13 sec. | 100 | 5 | 5 | 5 |
| Example 3 | Yes | 5 | Chemipearl W-308 | High-density polyethylene | 6 μm | 10 mass % | 11 sec. | 100 | 5 | 5 | 5 |
| Example 4 | Yes | 5 | Chemipearl W-308 | High-density polyethylene | 6 μm | 20 mass % | 8 sec. | 100 | 5 | 5 | 4 |
| Example 5 | Yes | 5 | Chemipearl W-200 | Low-density polyethylene | 6 μm | 5 mass % | 16 sec. | 100 | 5 | 5 | 5 |
| Example 6 | Yes | 5 | Chemipearl W-410 | Low-density polyethylene | 9.5 μm | 5 mass % | 12 sec. | 100 | 5 | 5 | 5 |
| Example 7 | Yes | 5 | A-100 | Thermoplastic elastomer | 4 μm | 5 mass % | 13 sec. | 100 | 5 | 5 | 5 |
| Example 8 | Yes | 5 | Technopolymer ARX-806 | Acrylic resin | 8 μm | 5 mass % | 18 sec. | 100 | 5 | 5 | 5 |
| Example 9 | Yes | 5 | SX-350H | Polystyrene | 6 μm | 5 mass % | 12 sec. | 100 | 5 | 5 | 5 |
| Example 10 | Yes | 5 | MX-500 | Crosslinked acrylic resin | 5 μm | 5 mass % | 10 sec. | 100 | 5 | 5 | 5 |
| Example 11 | Yes | 5 | P-510 | Silica | 4.5 μm | 5 mass % | 15 sec. | 110 | 5 | 3 | 5 |
| Example 12 | Yes | 5 | Chemipearl W-308 | High-density polyethylene | 6 μm | 1 mass % | 130 sec. | 100 | 3 | 3 | 5 |
| Example 13 | No | 90 | Chemipearl W-308 | High-density polyethylene | 6 μm | 5 mass % | 16 sec. | 80 | 5 | 5 | 3 |
| Example 14 | Yes | 40 | Chemipearl W-308 | High-density polyethylene | 6 μm | 5 mass % | 16 sec. | 90 | 5 | 5 | 5 |
| Comparative Example 1 | Yes | 5 | | — | | 0 mass % | 1000 sec. or more | 100 | 1 | 1 | 5 |
| Comparative Example 2 | — | | Chemipearl W-308 | High-density polyethylene | 6 μm | 5 mass % | 16 sec. | 30 | 5 | 5 | 1 |

As apparent from Table 2, the planographic printing plate precursors of Examples 1 to 14 were superior in sensitivity, adhesiveness, abrasion resistance, and lack of portions where the image was missing.

In contrast, the planographic printing plate precursor of Comparative Example 1 containing no filler in the protective layer was not satisfactory both in its adhesiveness and abrasion resistance. The planographic printing plate precursor of Comparative Example 2 having no oxygen barrier layer was also un satisfactory with regard to portions where the image was missing.

Example 15

(Preparation of Support)

An aluminum support was prepared in a similar manner to Example 1.

(Undercoat Layer)

Next, the following undercoat layer coating solution was applied onto the aluminum support by using a wire bar and dried at 90° C. for 30 minutes. The amount applied was 10 mg/m$^2$.

| <Undercoat layer-coating solution> | |
|---|---|
| Copolymer of ethyl methacrylate and 2-acrylamido-2-methyl-1-sodium propanesulfonate salt at a molar ratio of 75:15 | 0.1 g |
| 2-Aminoethylphosphonic acid | 0.1 g |
| Methanol | 50 g |
| Ion exchange water | 50 g |

(Photosensitive Layer)

Next, the following photosensitive layer coating solution (P-2) was prepared and applied onto the undercoat layer to a film thickness of 1.4 g/m$^2$ after drying with a foiler, and dried at 100° C. for 1 minute.

| <Photosensitive layer-coating solution> | |
|---|---|
| Ethylenic unsaturated compound: | 1.5 g |
| Compound of the following structural formula 1 | |
| Binder (polymer compound): | 2.0 g, |
| Compound of the following structural formula A-1 | |
| Sensitizer: | 0.1 g |
| Compound of the following structural formula 2 | |
| Initiator: | 0.2 g |
| Compound of the following structural formula 3 | |
| Cosensitizer: | 0.2 g |
| a compound of following formula 4 | |
| Coloring pigment dispersion (following composition) | 2.0 g |
| Heat-polymerization inhibitor: | 0.01 g |
| N-nitrophenylhydroxylamine ammonium salt | |
| Surfactant (Megafac F176, manufactured by Dainippon Ink and Chemicals, Inc.) | 0.02 g |
| Methylethylketone | 20.0 g |
| Propylene glycol monomethylether | 20.0 g |

Formula 1

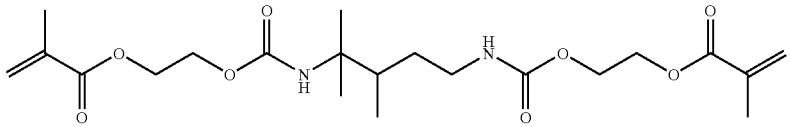

Formula 2

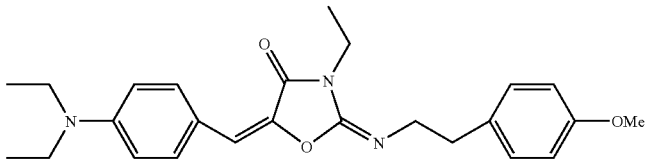

Formula 3

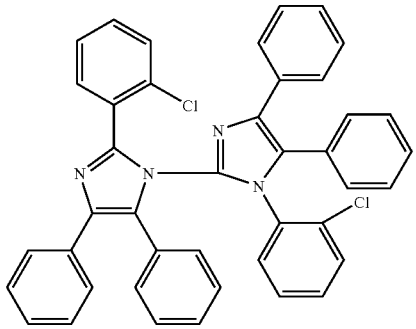

Formula 4

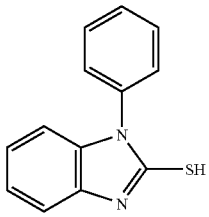

-continued

<Photosensitive layer-coating solution>

A-1

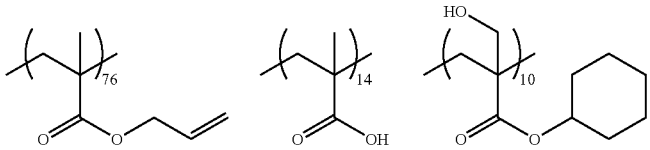

| <Composition of coloring pigment dispersion> | |
|---|---|
| Pigment Blue15:6 | 15 parts by mass |
| Allyl methacrylate/copolymer methacrylate (copolymerization molar ratio: 83/17) thermal polymerization | 10 parts by mass |
| Cyclohexanone | 15 parts by mass |
| Methoxypropyl acetate | 20 parts by mass |
| Propylene glycol monomethylether | 40 parts by mass |

(Oxygen Barrier Layer)

A mixed aqueous solution (oxygen barrier layer coating solution) containing a synthetic mica (Somasif ME-100, 8% aqueous dispersion, CO—OP Chemical Co., Ltd.), a specific polyvinylalcohol having a saponification degree of 91 mol % or more (GOHSERAN CKS-50, manufactured by Nippon Synthetic Chemical Industry Co., Ltd., saponification degree: 99 mol %, polymerization degree: 300, sulfonic acid-modified polyvinylalcohol), and a surfactant (Emalex 710, manufactured by Nihon-Emulsion Co., Ltd.) was coated on the photosensitive layer surface with a wire bar and dried in a hot air dryer at 125° C. for 75 seconds.

The content ratio of mica solid content/polyvinylalcohol/surfactant in the mixed aqueous solution (oxygen barrier layer-coating solution) was 18/80/2 (mass %), and the total coating amount (coating amount after drying) was 0.5 g/m$^2$.

The oxygen permeability of the oxygen barrier layer was determined according to the method described above.

(Protective Layer)

A mixed aqueous solution (protective layer coating solution) containing polyvinylalcohol (GOHSERAN CKS-50 manufactured by Nippon Synthetic Chemical Industry Co., Ltd., saponification degree: 99 mol %, polymerization degree: 300, sulfonic acid-modified polyvinylalcohol), a surfactant (Emalex 710, manufactured by Nihon-Emulsion Co., Ltd.), and a filler (Chemipearl W-308, manufactured by Mitsui Chemicals, Inc., high-density polyethylene particle, particle diameter: 6 μm) was coated on the oxygen barrier layer surface with a wire bar and dried in a hot air dryer at 125° C. for 75 seconds. The content rate of filler/polyvinylalcohol/surfactant in the mixed aqueous solution (protective layer-coating solution) was 5/91.5/4.5 (mass %), and the total coating amount (coating amount after drying) was 1.6 g/m$^2$.

Example 16

A planographic printing plate precursor of Example 16 was prepared in a similar manner as in Example 15, except that Chemipearl W-308 used as the filler in the mixed aqueous solution (protective layer coating solution) of Example 15 was replaced with SX-350H (3.5-μm polystyrene particle, manufactured by Soken Chemical & Engineering Co., Ltd.).

Comparative Example 3

A planographic printing plate precursor of Example 16 was prepared in a similar manner as in Example 15, except that the filler Chemipearl W-308 used in the mixed aqueous solution (protective layer-coating solution) of Example 15 was eliminated, the content ratio of polyvinylalcohol/surfactant in the mixed aqueous solution (protective layer-coating solution) was changed to 98/2 (% by mass), and the total coating amount (coating amount after drying) was changed to 1.6 g/m$^2$.

Comparative Example 4

A planographic printing plate precursor of Comparative Example 4 was prepared in a similar manner as in Example 15, except that the protective layer was formed directly on the photosensitive layer without forming the oxygen barrier layer of Example 15.

Evaluation (1-2) Evaluation of Sensitivity

The planographic printing plate precursors of Examples 15 to 16 and Comparative Examples 3 to 4 were left at room temperature (approximately 25° C.) for 4 days, and the entire surface of each plate precursor was exposed to light with a gray scale attached thereon in a plate setter Ux9600CtP manufactured by Fuji Film Electroimaging equipped with a 30-mW violet laser which was previously adjusted to a plate-surface light intensity of 0.1 mJ/cm$^2$. The gray scale had progressive multiple gray-scale steps having changes in light intensity by ($1/\sqrt{2}$) times. The plate precursor was then developed and subjected to platemaking in the following manner:

The cyan density of the image portion of the planographic printing plate after development was determined in Macbeth reflection densitometer RD-918 by using a red filter attached to the densitometer. The reciprocal of the exposure energy needed to give a measured density of 0.9 was used as an indicator of sensitivity.

The sensitivity of planographic printing plate was expressed relatively to 100 of the sensitivity of the planographic printing plate obtained in Example 15. A larger value means a higher sensitivity.

—Development Method—

The exposed plate was subjected to development/platemaking in an automatic developer LP-850P2 manufactured by Fuji Photo Film Co., Ltd. (preheat temperature: 100° C.), while the following developing solution and a finisher FP-2W manufactured by Fuji Photo Film Co., Ltd. were respectively supplied thereto, at a feeding developer-solution temperature of 30° C. and a developing period of 18 seconds, to give a planographic printing plate.

ation results are grouped into ranks 1 to 5, and rank 3 was at the lowest level acceptable in practice, and ranks 2 or less were at a level unusable in practice.

TABLE 3

| | Oxygen barrier layer | | Filler (in protective layer) | | | | | Evaluation | | | |
|---|---|---|---|---|---|---|---|---|---|---|---|
| | Presence of mica | Oxygen permeability | Trade Name | Kinds | Average particle diameter | Content ratio | Bekk smoothness | Sensitivity | Adhesiveness | Abrasion resistance | Image defects |
| Example 15 | Yes | 5 | Chemipearl W-308 | High-density polyethylene | 6 μm | 5 mass % | 13 sec. | 100 | 5 | 5 | 5 |
| Example 16 | Yes | 5 | SX-350H | Polystyrene | 6 μm | 5 mass % | 12 sec. | 100 | 5 | 5 | 5 |
| Comparative Example 3 | Yes | 5 | | — | | 0 mass % | 1000 sec. or more | 100 | 1 | 1 | 5 |
| Comparative Example 4 | — | | Chemipearl W-308 | High-density polyethylene | 6 μm | 5 mass % | 16 sec. | 30 | 5 | 5 | 1 |

<Developing solution>

| | |
|---|---|
| Sodium hydroxide | 0.15 parts by mass |
| Following compound (a) | 5.0 parts by mass |
| Ethylenediamine tetraacetic acid, 4 Na salt | 0.1 parts by mass |
| Water | 94.75 parts by mass |

(a)

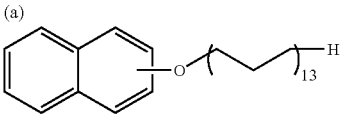

(2-2) Evaluation of Adhesion Between Planographic Printing Plate Precursors

The adhesion between planographic printing plates was evaluated, in a similar manner to Example 1.

(3-2) Evaluation of Abrasion Resistance 30 planographic printing plate precursors respectively obtained in Examples 15 to 16 and Comparative Examples 3 to 4 were stacked without inserting interleaf sheets, to give respective stacks. Top 29 plate precursors in the stack were shifted by 5 cm, and a solid image was formed on the bottom plate precursor.

The plate precursor was exposed to light in a plate setter Ux9600CtP manufactured by FUJIFILM Electronic Imaging Ltd. equipped with a 30-mW violet laser at a plate-surface light intensity of 0.1 mJ/cm$^2$.

After exposure, the plate precursor was developed, similarly to the evaluation of sensitivity. Scratching in the solid image formed on the planographic printing plate was evaluated by visual observation. Visual evaluation results are grouped into ranks 1 to 5, and rank 3 was at the lowest level acceptable in practice, and ranks 2 or less were at a level unusable in practice.

(4-2) Evaluation of Portions where the Image was Missing

A solid image was formed on the planographic printing plate precursor obtained in plate setter Ux9600CtP at an intensity of 0.05 mJ/cm$^2$. After exposure, the plate precursor was developed by the development method above in an automatic developer LP-850P2 manufactured by Fuji Photo Film Co., Ltd. (preheat temperature: 100° C.). Portions where the image was missing in the image region of the planographic printing plate developed was evaluated visually. Visual evalu- As apparent from Table 3, the planographic printing plate precursors of Examples 15 and 16 were superior in sensitivity, adhesiveness, abrasion resistance, and with respect to portions where the image was missing.

In contrast, the planographic printing plate precursor of Comparative Example 3 containing no filler in the protective layer was not satisfactory both in its adhesiveness and abrasion resistance. The planographic printing plate precursor of Comparative Example 4 having no oxygen barrier layer was unsatisfactory with respect to portions where the image was missing.

As described above, the invention provides a planographic printing plate precursor allowing image input with laser and having a photosensitive layer supporting polymerization inhibition that is resistant to adhesion and abrasion/scratching between the photosensitive layer side outermost layer and the rear surface of the next support even when multiple plate precursors are stacked without inserting interleaf sheets, and a stack of the planographic printing plate precursors.

All publications, patent applications, and technical standards mentioned in this specification are herein incorporated by reference to the same extent as if each individual publication, patent application, or technical standard was specifically and individually indication to be incorporated by reference.

What is claimed is:

1. A planographic printing plate precursor comprising: an aluminum support; and a photosensitive layer including a polymerization initiator, a polymerizable compound and a binder polymer; an oxygen barrier layer; and a protective layer including a filler, the layers being formed in this order on or above the support, wherein the filler is organic resin particles, the volume average particle diameter of the filler is in a range of from 1 to 20 μm and the content of the filler is in a range of from 0.1 to 20% by mass with respect to the total solid content in the protective layer;

wherein the protective layer further includes a binder polymer that is a polyvinylalcohol and the content of the binder polymer is in the range of from 45 to 95% by mass with respect to the total solid content in the protective layer; and wherein the oxygen permeability of the oxygen barrier layer is 0.5 to 50 ml/m$^2$.day at 25° C. and 60% RH.

2. The planographic printing plate precursor of claim 1, wherein the Bekk smoothness of the surface of the protective layer is 500 seconds or less.

3. The planographic printing plate precursor of claim 1, wherein the coating amount of the protective layer is in a range of from 0.1 to 4.0 $g/m^2$.

4. The planographic printing plate precursor of claim 1, wherein the oxygen barrier layer includes a binder polymer, an inorganic lamellar compound, and an oxygen permeability-controlling agent.

5. The planographic printing plate precursor of claim 4, wherein the binder polymer is a polyvinylalcohol.

6. The planographic printing plate precursor of claim 4, wherein the inorganic lamellar compound is a mica compound.

7. The planographic printing plate precursor of claim 4, wherein the content of the inorganic lamellar compound is in the range of from 5 to 50% by mass with respect to the total solid content in the oxygen barrier layer.

8. The planographic printing plate precursor of claim 1, wherein the coating amount of the oxygen barrier layer is in a range of from 0.1 to 4.0 $g/m^2$.

9. The planographic printing plate precursor of claim 1, wherein the photosensitive layer further includes: a polymerization initiator; and an infrared absorbent having an absorption maximum of from 700 to 1,300 nm, or a sensitizer having an absorption maximum of from 300 to 600 nm.

10. A stack of planographic printing plate precursors comprising a plurality of the planographic printing plate precursors of claim 1, wherein an outermost surface of a photosensitive layer side of a planographic printing plate precursor directly contacts a back surface of a support of an adjacent planographic printing plate precursor.

11. The planographic printing plate precursor of claim 1, wherein the content of the filler is in a range of from 1 to 15% by mass with respect to the total solid content in the protective layer.

* * * * *